US008857496B2

(12) United States Patent
Raniere

(10) Patent No.: US 8,857,496 B2
(45) Date of Patent: Oct. 14, 2014

(54) CONFIGURABLE AND INTERLOCKING PARTITIONING DEVICE, METHOD, AND SYSTEM OF USE THEREOF

(75) Inventor: Keith A. Raniere, Clifton Park, NY (US)

(73) Assignee: First Principles, Inc., Albany, NY (US)

( * ) Notice: Subject to any disclaimer, the term of this patent is extended or adjusted under 35 U.S.C. 154(b) by 458 days.

(21) Appl. No.: 11/868,995

(22) Filed: Oct. 9, 2007

(65) Prior Publication Data

US 2009/0090475 A1 Apr. 9, 2009

(51) Int. Cl.
*A47G 5/00* (2006.01)

(52) U.S. Cl.
USPC ..... 160/135; 52/239

(58) Field of Classification Search
USPC ..... 160/135, 180; 16/19; 52/239
See application file for complete search history.

(56) References Cited

U.S. PATENT DOCUMENTS

| | | | | | |
|---|---|---|---|---|---|
| 2,962,132 | A | | 11/1960 | Reinhardt | |
| 3,017,969 | A | | 1/1962 | Nielsen | |
| 3,570,683 | A | | 3/1971 | Dickgiesser et al. | |
| 4,161,850 | A | | 7/1979 | Peterson et al. | |
| 4,631,881 | A | * | 12/1986 | Charman | 52/220.7 |
| 4,774,792 | A | | 10/1988 | Ballance | |
| 4,785,565 | A | * | 11/1988 | Kuffner | 40/605 |
| 4,914,873 | A | | 4/1990 | Newhouse | |
| 4,932,172 | A | | 6/1990 | Maas | |
| 4,977,696 | A | * | 12/1990 | Johansson | 40/605 |
| 5,067,543 | A | * | 11/1991 | Bove | 160/135 |
| D330,646 | S | | 11/1992 | Maas | |
| D339,482 | S | | 9/1993 | Naylor | |
| 5,272,848 | A | | 12/1993 | Maas | |
| D345,018 | S | | 3/1994 | Maas | |
| 5,394,658 | A | | 3/1995 | Schreiner et al. | |
| 5,511,806 | A | | 4/1996 | McNair | |
| 5,584,546 | A | * | 12/1996 | Gurin et al. | 312/200 |
| 5,694,881 | A | | 12/1997 | Creech | |
| 5,896,710 | A | * | 4/1999 | Hoyle | 52/144 |
| 5,996,674 | A | * | 12/1999 | Gatewood | 160/348 |
| 6,009,930 | A | | 1/2000 | Jantschek | |
| 6,047,509 | A | * | 4/2000 | Savoie | 52/281 |
| 6,068,041 | A | | 5/2000 | Miles et al. | |
| 6,513,288 | B1 | * | 2/2003 | MacDonald et al. | 52/239 |
| 6,533,019 | B1 | * | 3/2003 | King et al. | 160/351 |
| 6,851,226 | B2 | * | 2/2005 | MacGregor et al. | 52/36.1 |
| 6,955,204 | B1 | * | 10/2005 | Gilbert et al. | 160/135 |

* cited by examiner

*Primary Examiner* — Blair M. Johnson
(74) *Attorney, Agent, or Firm* — Schmeiser, Olsen & Watts, LLP

(57) ABSTRACT

The invention relates generally to partitioning devices and methods for partitioning space. A device is presented comprising: at least one partition body; at least one motility assembly operably adapted to at least one partition body; and at least one interconnect, where the at least one interconnect is used to interchangeably link the at least one partition body in multiple configurations with another partition body. A method for partitioning space is presented comprising: providing a first partitioning device, where the partitioning device includes at least one interconnect, where the interconnect is used to interchangeably link the partitioning device body with a second partitioning device body; providing at least a first removably attachable portion on the first partitioning device; removing the removably attachable portion; and replacing the removably attachable portion with a second removably attachable portion, where the removably attachable portion is different than the first removably attachable portion.

6 Claims, 20 Drawing Sheets

CONFIGURABLE AND INTERLOCKING PARTITIONING DEVICE, METHOD, AND SYSTEM OF USE THEREOF

BACKGROUND OF THE INVENTION

1. Field of the Invention

The invention relates generally to a configurable partition that is mobile and interconvertible in configuration. A method and system of use thereof is also disclosed.

2. Related Art

There is a need for an improved partition that offers increased flexibility of use and configurability than existing partition devices and partition systems which overcomes at least one of the aforementioned and possibly other deficiencies, in the art of partitions and partition systems.

SUMMARY OF THE INVENTION

The present invention provides a device, a method, and a system of use thereof for partitioning areas or spaces which overcomes at least one of the aforementioned deficiencies.

One general aspect of the present invention provides a device comprising: at least one partition body; at least one motility assembly operably adapted to at least one said partition body; and at least one interconnect, wherein said at least one interconnect is used to interchangeably link said at least one partition body in multiple configurations with another partition body.

A second general aspect of the present invention provides a method for partitioning space comprising: providing a first partitioning device, wherein said partitioning device includes at least one interconnect, wherein said interconnect is used to interchangeably link said partitioning device body with a second partitioning device body; providing at least a first removably attachable portion on said first partitioning device; removing said removably attachable portion; and replacing said removably attachable portion with a second removably attachable portion, wherein said removably attachable portion is different than said first removably attachable portion.

A third general aspect of the present invention provides a system for partitioning space comprising: at least one first partitioning device, wherein said partitioning device includes at least one interconnect, wherein said interconnect is used to interchangeably link said partitioning device body with a second partitioning device body; at least a first removably attachable portion on said first partitioning device; and a second removably attachable portion, wherein said removably attachable portion is different than said first removably attachable portion.

The foregoing and other features and advantages of the invention will be apparent from the following more particular description of embodiments of the invention. It is to be understood that both the foregoing general description and the following detailed description are exemplary, but are not restrictive, of the invention.

BRIEF DESCRIPTION OF THE DRAWINGS

Some of the embodiments of this invention will be described in detail, with reference to the following figures, wherein like designations denote like members wherein.

DETAILED DESCRIPTION OF THE INVENTION

Figure 1:
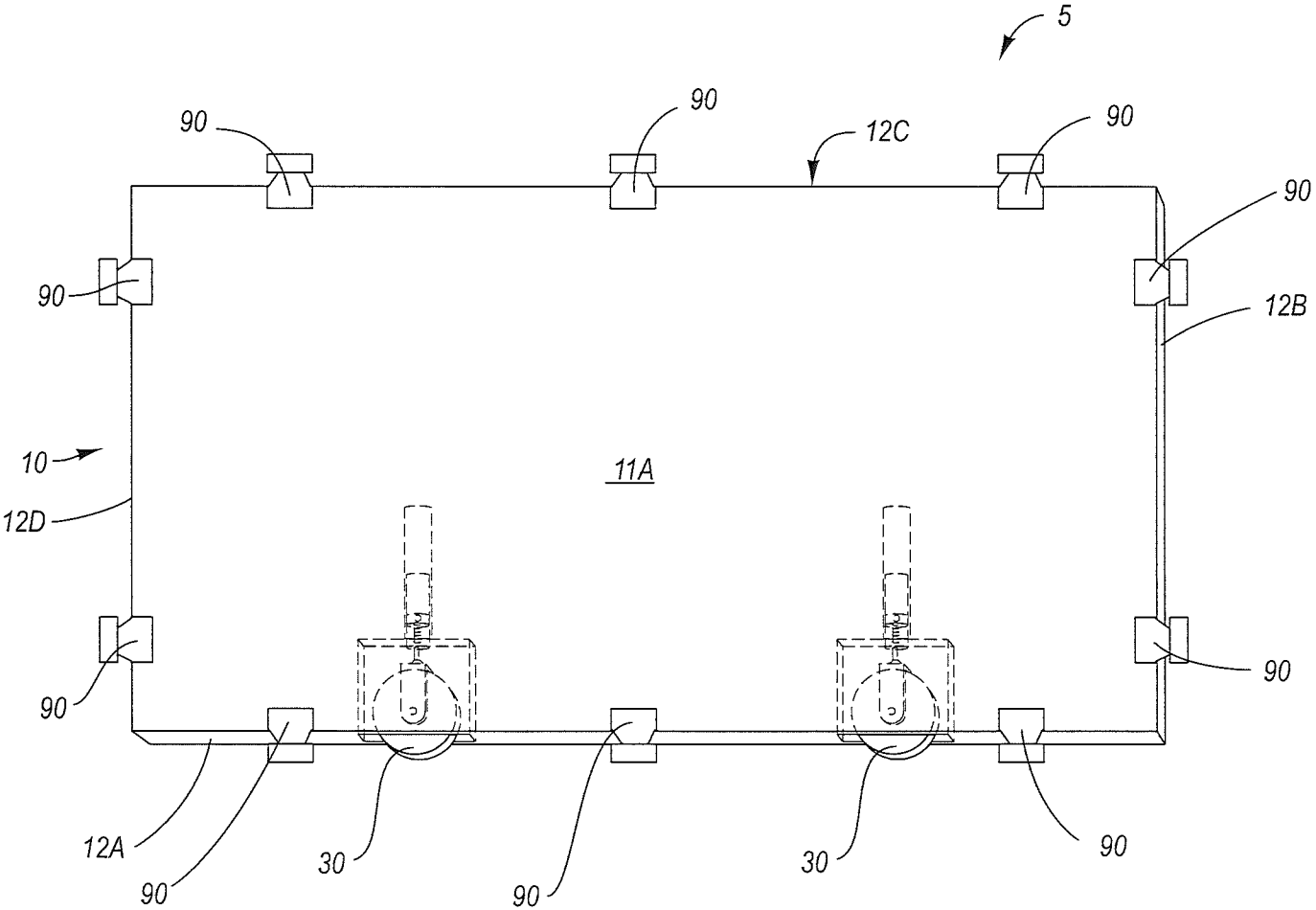
FIG. 1 depicts a perspective view of a partitioning device, in accordance with the present invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the"include plural referents, unless the context clearly dictates otherwise.

The present invention offers an improved partitioning device as well as a method and system of use thereof. The present invention offers greater flexibility and more options for configuration than current partitioning devices known in the art. The term partition as used herein denotes a structure, either substantially or partially solid, which separates or divides an area or space into two or more sub-areas or subspaces. Partitions can be used, for example, to divide a room having an area into smaller areas.

For example, the present invention provides for a partition that provides many features including: a capability to attach or interlock two or more partitions together; a capability to attach or interlock two or more partitions together in a plurality of configurations; and a capability to readily move partitions.

FIG. 1 depicts a perspective view of a partitioning device 5, in accordance with the present invention. As shown in FIG. 1, an embodiment of the present invention is a partitioning device 5 comprising: a partition body 10, a motility assembly 30, and interconnects 90. A definition of partition body 10 components follows. In a macroscopic view, a partition body is a three-dimensional form comprised of a plurality of surfaces. Each surface may generally be referred to as a side. A face is a special type of a side. It is a principal, prominent side of a partition body 10. A side, hereafter, is any secondary side of a partition body 10. A partition body 10 comprises: at least one face and at least one side. A partition body face typically has a much larger area than a partition body side. As represented in the FIG. 1 embodiment, the body 10 is rectangular in shape forming a cuboid. It should be noted, however, that although the components of the FIG. 1 embodiment are rectangular, partition body shapes may also include but are not limited to other shapes such as triangle, polygons of any number of sides, circle, ellipse, super-ellipse, oval, and combinations thereof. A partition body face 11A and sides 12A, 12B, 12C, and 12D, as represented in the FIG. 1 embodiment, may be substantially flat or they may be three dimensional surfaces of any configuration or design. Although not shown in FIG. 1, it should be apparent that a partition body face exists opposite 11A. Furthermore, partition body faces and sides, may be comprised of one or more components. Partition body faces and sides may be removably attachable to a partition body.

Figure 2A:
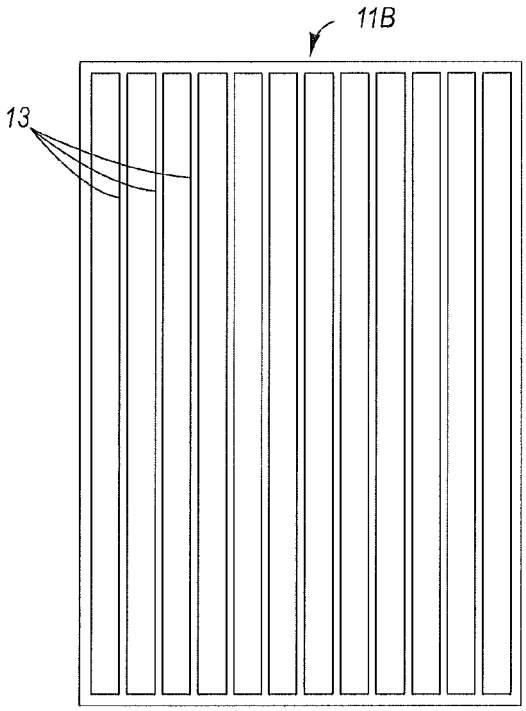
FIG. 2A depicts a face of a first embodiment of a partitioning device, in accordance with the present invention.

In one configuration of a partition body, the partition body faces are made of fabric type materials that may be natural or synthetic. Examples of fabric type materials include but are not limited to polyester, rayon, nylon, sateen, spandex, plastic, cotton, satin, silk, and combinations thereof. Alternatively, the materials used for partition body faces also may include but are not limited to solid type materials that may be natural or synthetic. Examples of solid type materials include but are not limited to steel, aluminum, sheet rock, wood, plexiglass, fiber glass, sound deadening material, nanocomposites, and combinations thereof. The partition body may have for example the partition body faces may be entirely opaque, entirely translucent or any degree of transparency in between. The partition body faces may have surfaces configured to deaden sound. Additionally, partition body faces may be removably replaced with entire partition body faces or subcomponents of different materials, colors, designs, etc. Replacing partition body faces may be done to change the appearance and/or function of the partition body faces. For example, a first partition body face, colored red, may be removed and replaced with a second partition body face, colored green. Likewise, a first partition body face, constructed of wood paneling, may be removed and replaced by a second partition body face, constructed of sound deadening material and having surfaces configured to deaden sound. Typically, partition body faces are about 3 feet by about 6.5 feet. The partition body faces may be any size that allows for the partition body 10 to maintain the capability of dividing an area into a smaller area. FIG. 2A depicts a partition body face 11B of a partition body 10, in accordance with the present invention. One embodiment is the partition body 10 having a partition body face 11B that is cage like in structure. Referring to FIG. 2A, the partition body face 11B is comprised of parallel slats that substantially span the entire partition body face. Typically, the slats 13 are about 5 inches apart but may be spaced from each other in a range from about 1 inch to about 10 inches. Further, the slats 13 typically are 1 inch in width but may range from about 0.5 inch to about 3 inches in width.

Figure 2B:
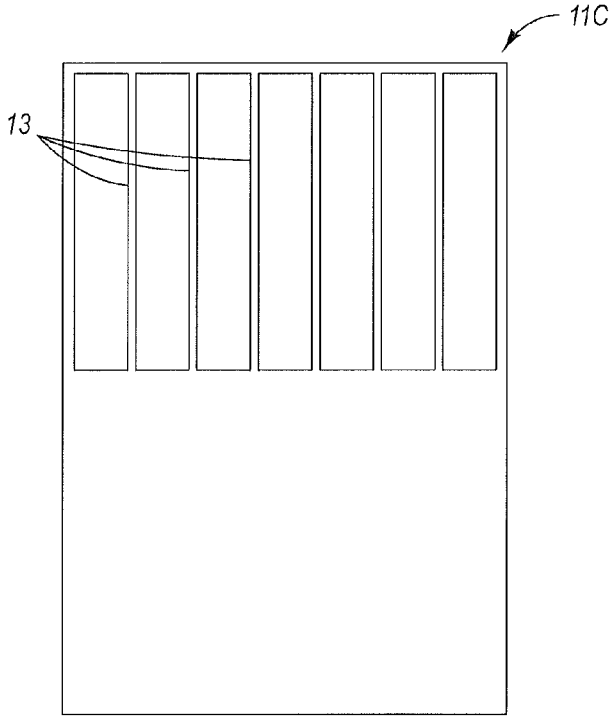
FIG. 2B depicts a face of a second embodiment of a partitioning device, in accordance with the present invention.

FIG. 2B depicts a partition body face 11C of the partition body 10 in accordance with the present invention. One embodiment is the body 10 having the face 11C that also is cage like in structure. Referring to FIG. 2B, the face 11C is comprised of parallel slats 13. The slats 13 do not span the entire partition body face 11C, but instead stop at some intermediate point. The slats 13 extend from one edge of the partition body face 11C toward an opposite end a distance from about 0.5 feet to about 3 feet. This configuration of the face 11C allows from about 4.5 feet to about 2 feet of the face 11C to be solid like in structure. Alternatively, the slats 13 may begin or end at any location on a partition body face. Typically, the slats 13 are about 5 inches apart but may be spaced from each other in a range from about 1 inch to about 10 inches.

Figure 2C:
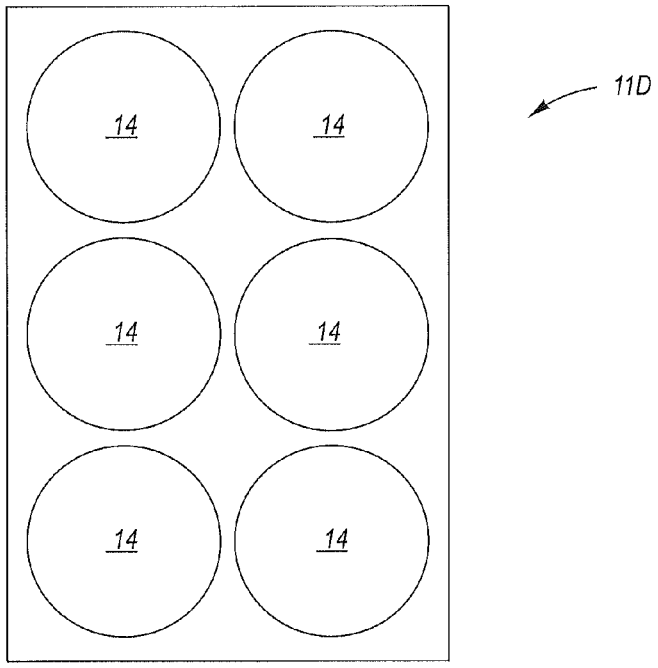
FIG. 2C depicts a face of a third embodiment of a partitioning device, in accordance with the present invention.

FIG. 2C depicts a partition body face 11D of the partition body 10 in accordance with the present invention. One embodiment is the partition body 10 having the face 11D with circular cutouts 14 distributed throughout. The cutouts 14 may be of any shape or size. Other cutout shapes may be stars, rectangles, triangles, spheroids, or any other decorative or functional shape. In choosing the cutout 14 designs or patterns to be used in a face 11D, the designs or patterns previously described are not meant to limit the scope of the cutout 14 that may be used in the face 11D of the partition body 10. Any cutout 14 design or pattern that can be envisioned and/or reduced to practice may be used in the face 11D. The size of the cutouts 14 used in a face 11D typically range from about 5 inches to about 15 inches. The number of cutouts 14 used in the face 11D ranges from about 2 to about 15 in number. The number and size of the cutouts 14 used in the face 11D are only limited by the size of the partition face 11D.

Figure 2D:
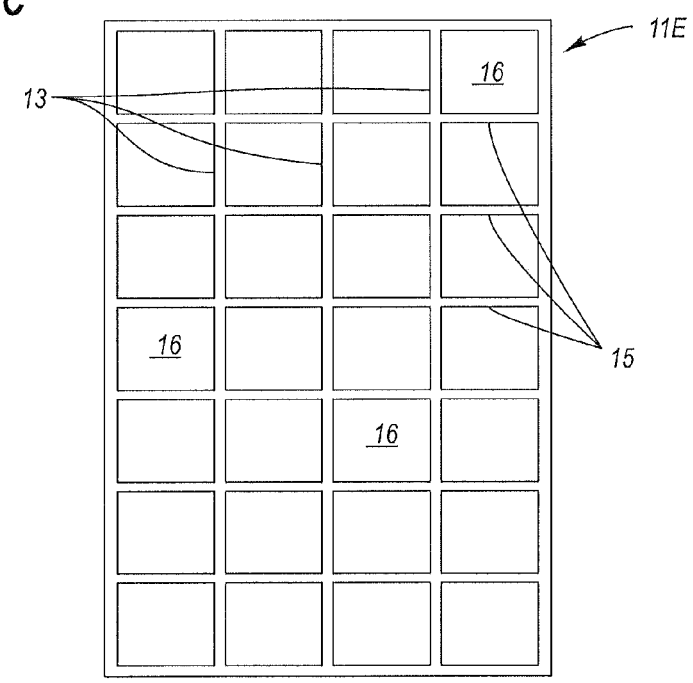
FIG. 2D depicts a face of a fourth embodiment of a partitioning device, in accordance with the present invention.

FIG. 2D depicts a partition body face 11E of the partition body 10 in accordance with the present invention. One embodiment is the partition body 10 having the partition body face 11E that is mesh like in structure. Referring to FIG. 2D, the partition body face 11E is comprised of parallel slats 13 that intersect at a right angle with parallel slats 15 forming spaces 16. Typically, the slats 13 and 15 are about 5 inches apart, respectively, but may be spaced apart in a range from about 1 inch to about 10 inches. Furthermore, the slats 13 and 15 are typically 1 inch in width but may range from about 0.5 inch to about 3 inches in width.

Figure 2E:
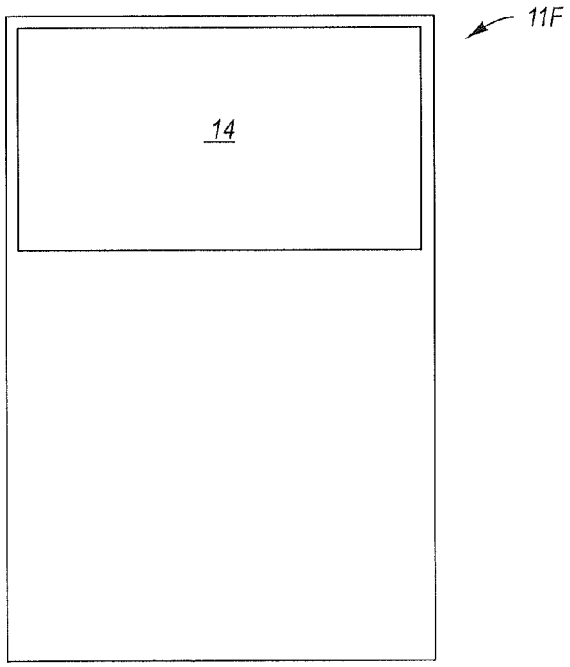
FIG. 2E depicts a face of a fifth embodiment of a partitioning device, in accordance with the present invention.

FIG. 2E depicts a partition body face 11F of the partition body 10 in accordance with the present invention. One embodiment is the partition body 10 having the partition body face 11F that has a rectangular cut out 14 that constitutes a substantial area of the partition body face 11F. Referring to FIG. 2E, the cut out 14 has dimensions in a range from about 2.5 feet by about 4.5 feet. The dimensions given are not meant to limit the size of the cut out 14 that may be used with the face 11F. The cut out 14 may range in dimensions between from about 2.5 feet by about 2.5 feet to from about 2.5 feet by about 5.5 feet. This configuration of the face 11F allows from about 4.5 feet by about 2 feet of the face 11F to be solid like in structure.

Figure 2F:
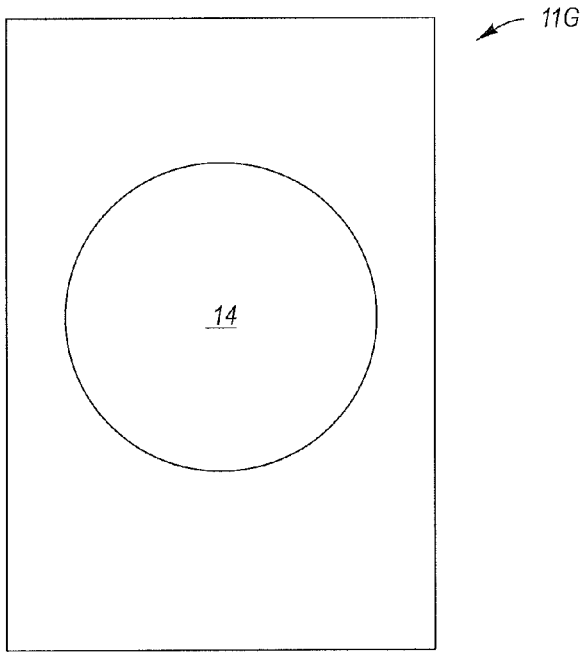
FIG. 2F depicts a face of a sixth embodiment of a partitioning device, in accordance with the present invention.
Figure 3A:
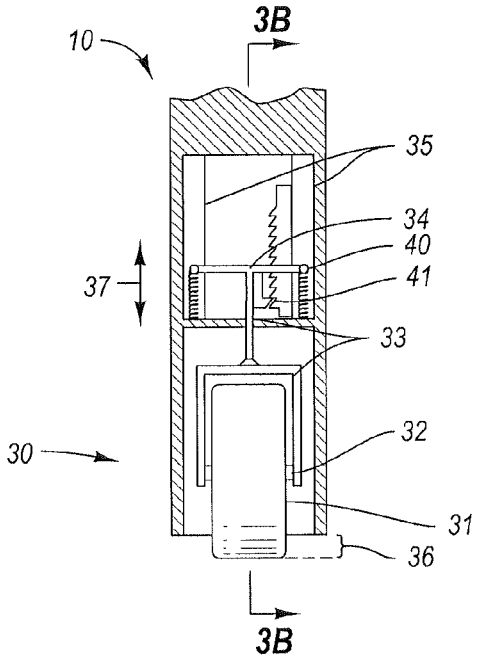
FIG. 3A depicts a cut away end view of a first embodiment of a motility assembly of the device in an extended configuration, in accordance with the present invention.
Figure 3B:
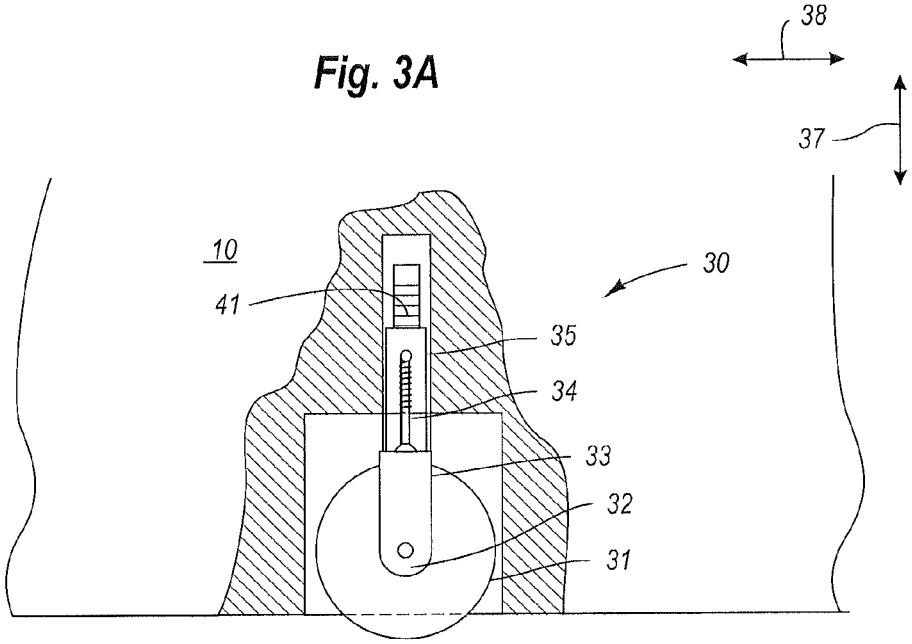
FIG. 3B depicts a cut away side view of a first embodiment of the motility assembly of the device in an extended configuration, in accordance with the present invention.
Figure 4A:
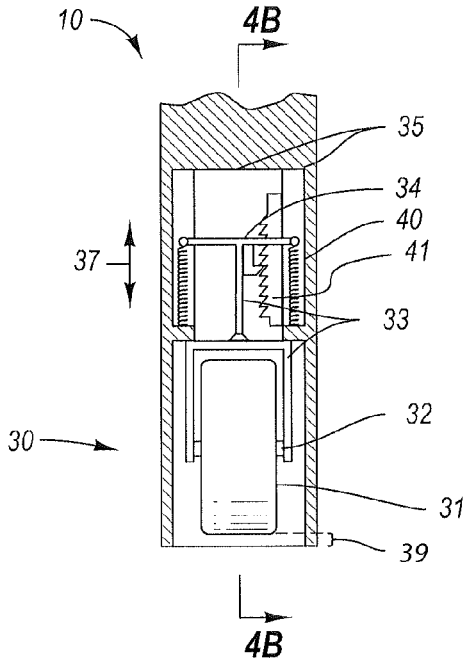
FIG. 4A depicts a cut away end view of a first embodiment of a motility assembly of the device in a retracted configuration, in accordance with the present invention.
Figure 4B:
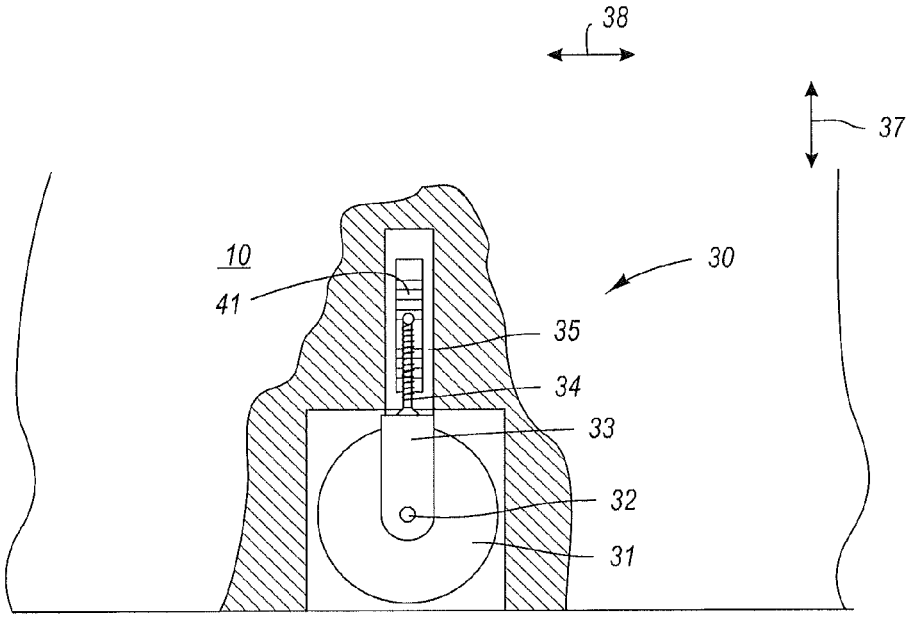
FIG. 4B depicts a cut away side view of a first embodiment of a motility assembly of the device in a retracted configuration, in accordance with the present invention.
Figure 5A:
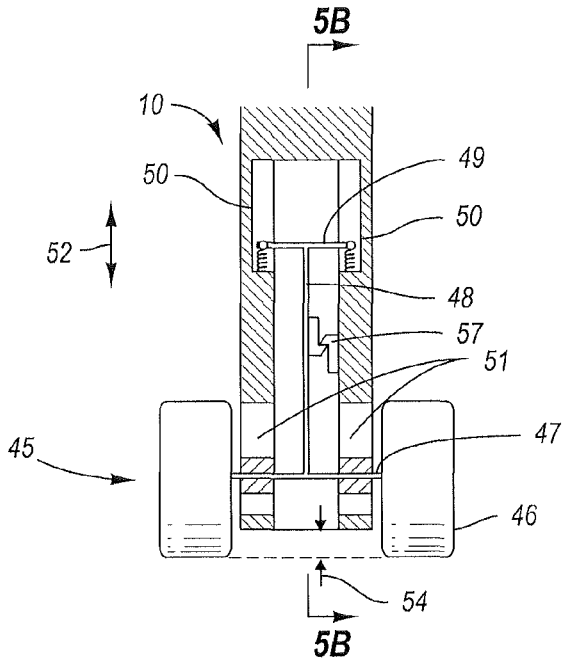
FIG. 5A depicts a cut away end view of a second embodiment of a motility assembly of the device in an extended configuration, in accordance with the present invention.
Figure 5B:
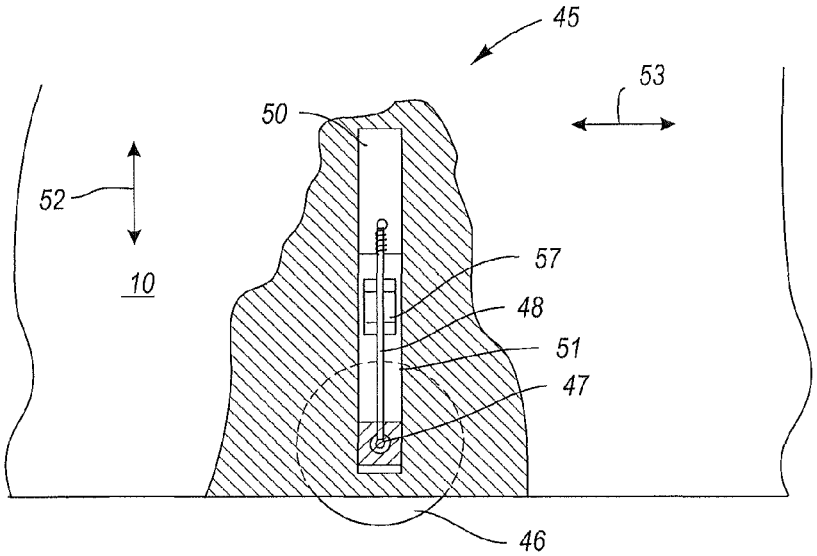
FIG. 5B depicts a cut away side view of a second embodiment of a motility assembly of the device in an extended configuration, in accordance with the present invention.
Figure 6A:
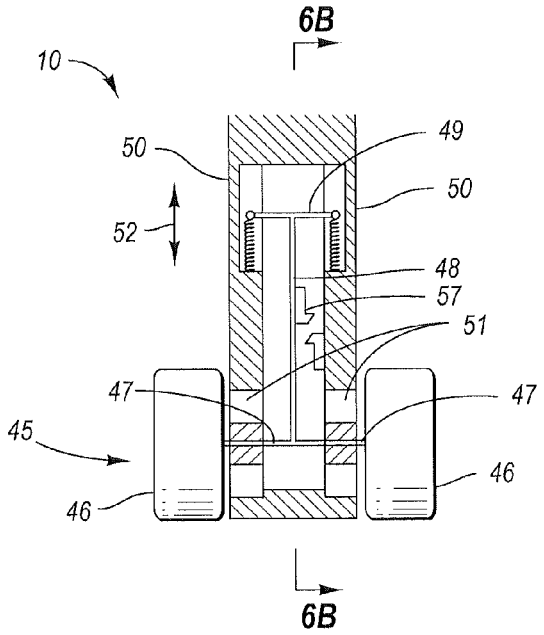
FIG. 6A depicts a cut away end view of a second embodiment of a motility assembly of the device in a retracted configuration, in accordance with the present invention.
Figure 6B:
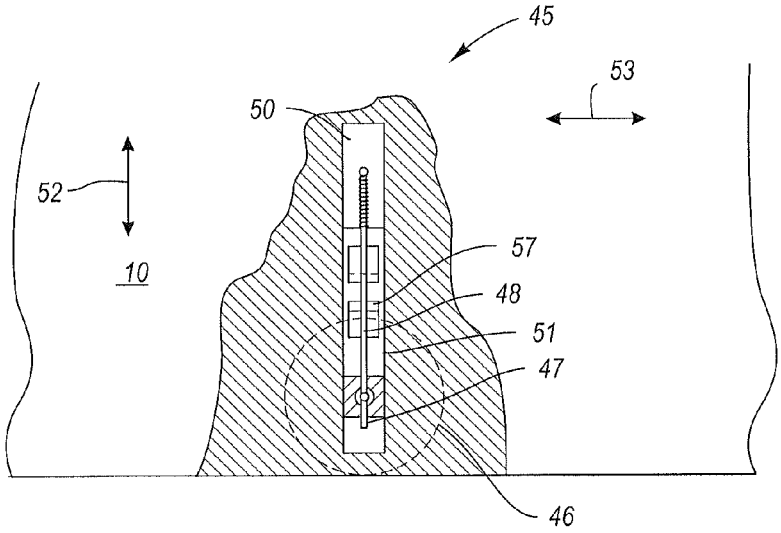
FIG. 6B depicts a cut away side view of a second embodiment of a motility assembly of the device in a retracted configuration, in accordance with the present invention.
Figure 7A:
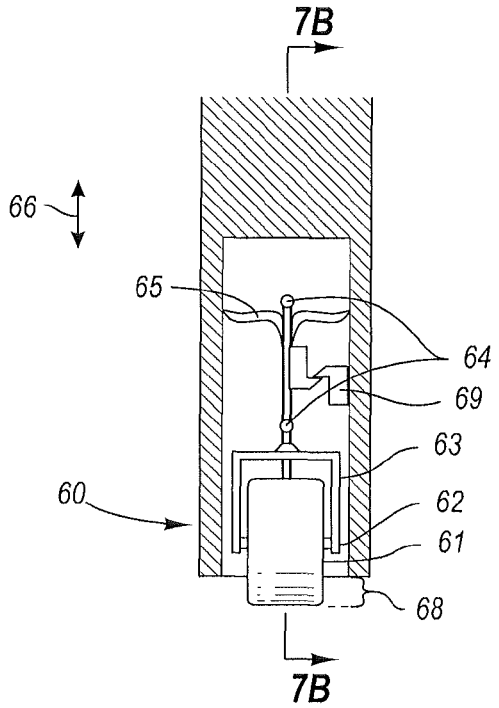
FIG. 7A depicts a cut away end view of a third embodiment of a motility assembly of the device in an extended configuration, in accordance with the present invention.
Figure 7B:
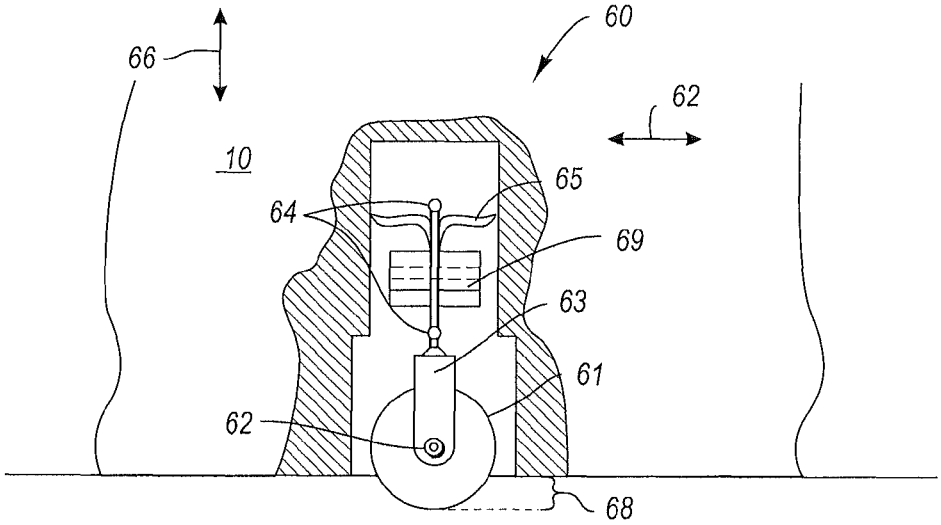
FIG. 7B depicts a cut away side view of a third embodiment of a motility assembly of the device in an extended configuration, in accordance with the present invention.
Figure 8A:
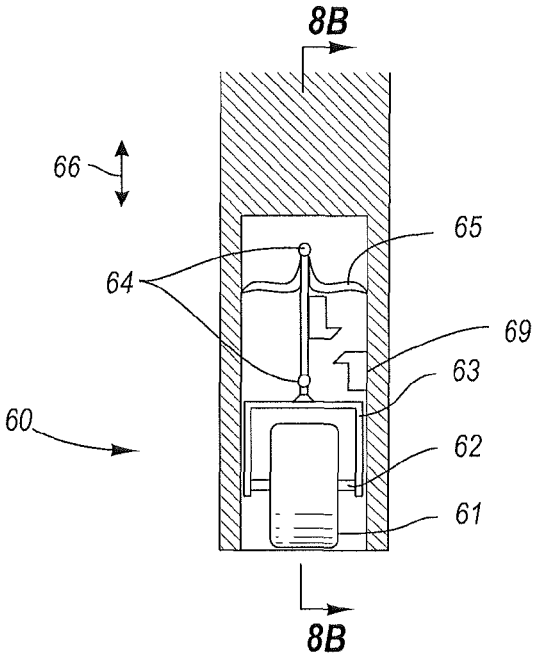
FIG. 8A depicts a cut away end view of a third embodiment of a motility assembly of the device in a retracted configuration, in accordance with the present invention.
Figure 8B:
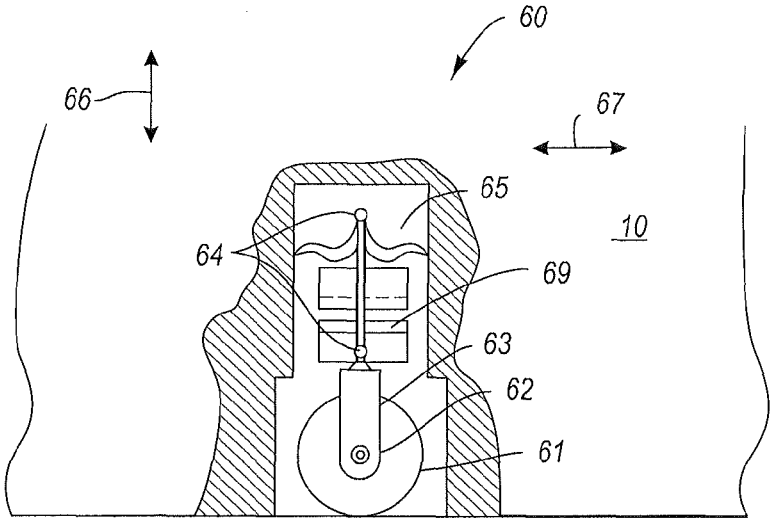
FIG. 8B depicts a cut away side view of a third embodiment of a motility assembly of the device in a retracted configuration, in accordance with the present invention.
Figure 9A:
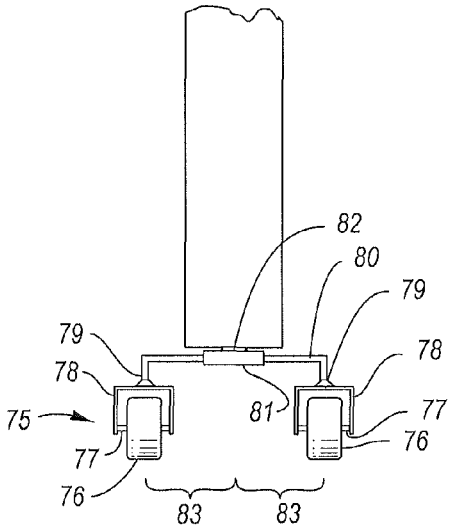
FIG. 9A depicts a cut away end view of a fourth embodiment of a motility assembly of the device in an extended configuration, in accordance with the present invention.
Figure 10A:
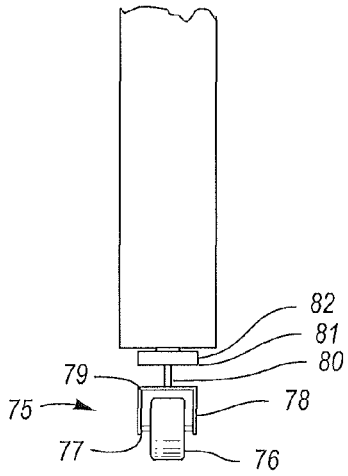
FIG. 10A depicts a cut away end view of a fourth embodiment of a motility assembly of the device in a retracted configuration, in accordance with the present invention.
Figure 9B:
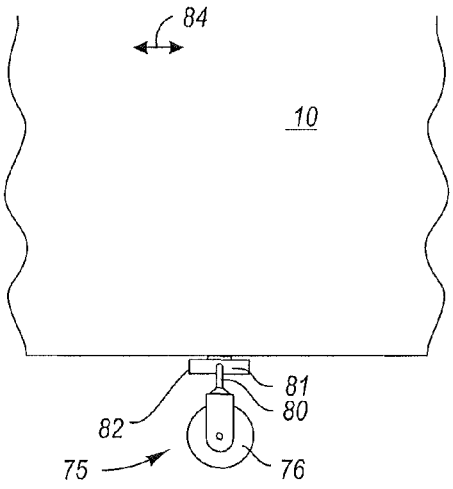
FIG. 9B depicts a cut away side view of a fourth embodiment of a motility assembly of the device in an extended configuration, in accordance with the present invention.
Figure 10B:
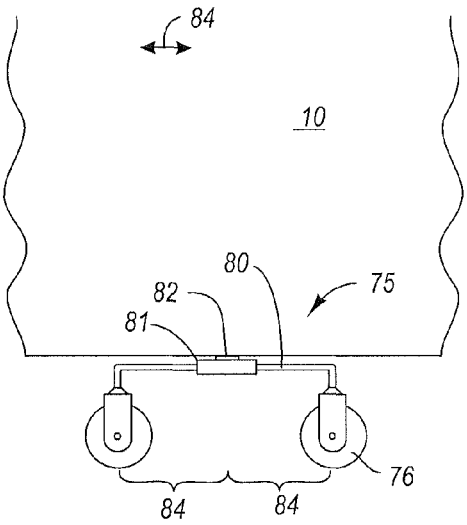
FIG. 10B depicts a cut away side view of a fourth embodiment of a motility assembly of the device in a retracted configuration, in accordance with the present invention.

FIG. 2F depicts a partition body face 11G of the partition body 10 in accordance with the present invention. One embodiment is the partition body 10 having the partition body face 11G that has a substantial circular cutout 14. Referring to FIG. 2F, the face 11G is comprised of a single cutout 14. The cutout 14 may by in any shape or size that constitutes a substantial part of the face 11G. The cutouts 14 may be of any shape or size. Other cutout shapes may be stars, rectangles, triangles, spheroids, or any other decorative or functional shape. In choosing the cutout 14 designs or patterns to be used in a face 11G, the designs or patterns previously described are not meant to limit the scope of the cutout 14 that may be used in the face 11G of the partition body 10. Any cutout 14 design or pattern that can be envisioned and/or reduced to practice may be used in the face 11G. The size of the cutout 14 used in a face 11G typically range from about 20% to from about 80% of the area of the face 11G.

Referring to FIG. 1, the dimensions of the sides 12B and 12D are typically in range from about 3 inches by about 3.5 feet to about 5 inches by about 5 feet, and the dimensions of the sides 12A and 12C are in a range from about 3 inches by about 6 feet to about 5 inches by about 7 feet. At least one of the sides 12A, 12B, 12C, and 12D is capable of having at least one motility assembly 30 operatively attached or operably integrated into the sides 12A-12D. At least one of the sides 12A, 12B, 12C, and 12D are capable of functioning as a base for the partition body 10 at any given time.

As shown in FIGS. 3A, 3B, 4A, and 4B, one embodiment of the present invention focuses on a motility assembly 30 operably integrated within a partition body 10. The assembly 30 may comprise: a wheel 31, an axel 32, an axel mount 33, a wheel mount 34, a wheel mount guide 35, a spring 40, and a locking mechanism 41. The wheel 31 may have a diameter from about 2 inches to about 6 inches and a width from about 0.5 inches to about 3 inches. The wheel 31 is centered and rotates about the axel 32. The axel mount 33 connects the axel 32 with the wheel mount 34. The wheel mount 34 is further configured to move within the wheel mount guide 35. The mount guides 35 are operably attached to the partition body 10. The spring 40 may couple the wheel mount 34 to the wheel mount guide 35. The spring 40 may be configured to provide a force to extend the wheel 31 out of the partition body 10 and/or to retract the wheel 31 within the partition body 10. A locking mechanism 41 may be configured to lock the wheel 31 in an extended position out of the partition body 10 and/or in a retracted position within the partition body 10. The locking mechanism may be released via a lever accessible outside of the partition body 10. Alternatively, in place of a spring 40, a lever accessible outside a partition body 10 may be used to apply a force to extend the wheel 31 out of the partition body 10 and/or to retract the wheel 31 within the partition body 5. Wheel movement is indicated by the direction arrow 37.

In the extended configuration (See FIGS. 3A and 3B), typically the wheel 31 is extended a distance 36 below a partition body 10 side from about 0.5 to about 2.5 inches. In this configuration, a partitioning device may be moved along a surface by simply applying force along the directional arrow 38. The extended configuration allows a partitioning device to roll across the surface along the directional arrow 38.

In the retracted configuration (See FIGS. 4A and 4B), typically the wheel 31 is retracted a distance 39 above a partition body 10 side from about 0.5 inches to about 2.5 inches. In this configuration, a partitioning device may rest and support itself on a surface using one of the partition body sides. Access between the two configurations is accomplished via the wheel mount guides 35. The retracted configuration (See FIGS. 4A and 4B) can be accessed from the extended configuration (See FIGS. 3A and 3B) by simply applying a force downward along the directional arrow 37. This causes the wheel mount 34 to move upward along the directional arrow until the wheel 31 is a retracted distance 39 from a partition body 10 side thus accessing the retracted configuration.

Accessing the extended configuration from the retracted configuration is accomplished by applying an upward force along the directional arrow 37 lifting a partition body 10 side off of the supporting surface. This will cause the wheel mount 34 to automatically move downward within the wheel mount 35 and along the directional arrow 37 until the wheel 31 has been extended a distance 36 below a partition body 10 side. The mechanism of extension and retraction of the wheel 31 is via a pressure loaded spring system within the wheel mount 35. The spring system reacts to upward and downward forces automatically extending or retracting the wheel 31. The spring system may have a locking mechanism to hold the wheel 31 in an extended or a retracted position.

As shown in FIGS. 5A, 5B, 6A, and 6B, one embodiment of the present invention focuses on the assembly 45 operably integrated onto the outside of a partition body 10 face. The assembly 45 may comprise: a wheel 46, an axel 47, an axel mount 48, a wheel mount 49, wheel mount guides 50, and axel guides 51, a spring 56, and a locking mechanism 57. The wheel 46 has a diameter from about 2 inches to about 6 inches and a width from about 0.5 inches to about 3 inches. The wheel 46 is centered and rotates about the axel 47. The axel mount 48 connects the axel 47 with the wheel mount 49. The wheel mount 49 is further configured to move within the wheel mount guide 50. The mount guides 50 are operably attached to the partition body 10. The spring 56 may couple the wheel mount 49 to the wheel mount guide 50. The spring 56 may be configured to provide a force to extend the wheel 46 below a partition body 10 side and/or to retract the wheel 31 above a partition body 10 side. A locking mechanism 57 may be configured to lock the wheel 46 in an extended position below a partition body 10 side and/or in a retracted position above a partition body 10 side. The locking mechanism may be released via a lever accessible outside of the partition body 10. Alternatively, in place of a spring 56, a lever accessible outside a partition body 10 may be used to apply a force to extend the wheel 46 below the partition body 10 side and/or to retract the wheel 46 above a partition body 10 side. Wheel movement is indicated by the direction arrow 52.

In the extended configuration (See FIGS. 5A and 5B), typically the wheel 46 is extended a distance 54 below the partition body 10 side from about 0.5 to about 2.5 inches. In this configuration, a partitioning device may be moved along a surface by simply applying force along the directional arrow 53.

In the retracted configuration (See FIGS. 6A and 6B), typically the wheel 46 is retracted a distance allowing the wheel 46 to be in line with or slightly above a partition body 10 side. In this configuration, a partitioning device may rest and support itself on a partition body 10 side or using the wheels 46. Access between the retracted and extended configurations may be accomplished via the wheel mount guides 50 and the axel guide 51. The retracted configuration (See FIGS. 6A and 6B) can be accessed from the extended configuration (See FIGS. 5A and 5B) by simply applying a force downward along the directional arrow 52. This causes the wheel mount 49 to move upward along the directional arrow until the wheel 46 is a retracted distance 54, to a partition body 10 side, thus accessing the retracted configuration. The axel guide 51 may be a slot that to allow the axel 47 to move upwards along the directional arrow 52 during the retraction and extension steps.

Accessing the extended configuration from the retracted configuration is accomplished by applying an upward force along the directional arrow 52 lifting a partition body 10 side off of a supporting surface. This will cause the wheel mount 49 to automatically move downward within the wheel mount guide 50 and along the directional arrow 52 until the wheel 46 has been extended a distance 54 below a partition body 10 side. The mechanism of extension and retraction of the wheel 47 may be by a pressure loaded spring system within the wheel mount guide 50. The spring system may react to upward and downward forces automatically extending or retracting the wheel 46. The spring system may have a locking mechanism to hold the wheel 46 in an extended or a retracted position.

As shown in FIGS. 7A, 7B, 8A, and 8B, one embodiment of the present invention focuses on the assembly 60 operably integrated within a partition body 10. The assembly 60 may comprise: a wheel 61, an axel 62, an axel mount 63, a wheel mount 64, and a wheel mount guide 65. The wheel 61 has a diameter from about 5 inches to about 6inches and a width from about 0.5 inches to about 3 inches. The wheel 61 is centered and rotates about the axel 62. The axel mount 63 connects the axel 62 with the wheel mount 64. The wheel mount 64 is further connected to the wheel mount guide 65. The mount guide 65 is operably attached to the inside of the partition body 10.

In the extended configuration (See FIGS. 7A and 7B), typically the wheel 61 is extended a distance 68 below a partition body 10 side from about 0.5 to about 2.5 inches. In this configuration, a partitioning device may be moved along a surface by simply applying force along the directional arrow 67. This causes a partitioning device to roll across the surface along the directional arrow 67.

In the retracted configuration (See FIGS. 8A and 8B), typically the wheel 61 is retracted a distance allowing the wheel 61 to be in line with or slightly above a partition body 10 side. In this configuration, a partitioning device may rest and support itself on a partition body 10 side or using the wheel 61. Access between the extended and retracted configurations is accomplished via the wheel mount guide 65. The retracted configuration (See FIGS. 8A and 8B) can be accessed from the extended configuration (See FIGS. 7A and 7B) by simply applying a force downward along the directional arrow 66. This causes the wheel mount 65 to move upward along the directional arrow 66 until the wheel 61 is retracted to a partition body 10 side.

Accessing the extended configuration from the retracted configuration is accomplished by applying an upward force along the directional arrow 66 lifting a partition body 10 side off of a supporting surface. This will cause the wheel mount guide 65 to automatically move downward along the directional arrow 66 until the wheel 61 has been extended a distance 68 below the partition body 10 side. The mechanism of extension and retraction of the wheel 61 is by a reversibly conforming wheel mount guide 65.

The wheel mount 65 reacts to upward and downward forces automatically causing the wheel mount guide 65 to conform to one of two shapes. The wheel mount is in an inverted shape, as in FIGS. 7A and 7B, causing the wheel 61 to be in an extended configuration. The wheel mount 65 is in a converted shape, as in FIGS. 8A and 8B, causing the wheel to be in a retracted configuration. The wheel mount 65 is reversibly conformable due to the materials of the wheel mount 65. The wheel mount 65 may be constructed of materials including but not limited to steel, aluminum, copper, brass, ceramic composites, polymer composites, nano-composites, alloys of the aforementioned, and combinations thereof.

As shown in FIGS. 9A, 9B, 10A, and 10B, one embodiment of the present invention focuses on the assembly 75 operably integrated on a partition body 10. The assembly 75 comprises: wheels 76, axels 77, axel mounts 78, wheel swivels 79, a wheel mount 80, a wheel mount pin 81, and a swivel 82. The wheels 76 have a diameter from about 2 inches to about 6 inches and a width from about 0.5 inches to about 3 inches. The wheels 76 are centered and rotate about the axels 77. The axel mounts 78 connect the axels 77 with the wheel swivels 79. The wheel swivels 79 are connected to the wheel mount 80. The mount 80 is connected to the wheel mount pin 81 which is connected to partition body 10 via the swivel 82.

In a first configuration (See FIGS. 9A and 9B), the assembly 75 extends laterally outwards from the partition body 10. The wheels 76 are extended a distance 83 from about 3 inches to about 7 inches. In this configuration, a partitioning device may be moved along a surface by simply applying force along a directional arrow 84. In the first configuration the assembly 75, specifically the wheels 76, may be used to assist in stabilizing and/or supporting a partitioning device on the surface.

In a second configuration (See FIGS. 10A and 10B), the assembly 75 extends parallel and directly underneath the face 12A. The wheels 76 are extended a distance 83 from about 3 inches to about 7 inches. In this configuration, the wheels 76 and the entire assembly 75 are out of the way. In the second configuration, a partitioning device may rest and support itself on the surface via the assembly 75. In the second configuration, a partitioning device may also be moved along a surface by simply applying force along a directional arrow 84.

Conversion between the first and second configuration is accomplished via the swivel 82. The first configuration (See FIGS. 9A and 9B) can be accessed from the second configuration (See FIGS. 10A and 10B) by applying a force on the wheel mount 80. The force causes the wheel mount pin 81, and subsequently the assembly 75, to rotate or spin about the swivel 82. The force may be continuously applied until the assembly 75 is parallel and under a partition body 10 side, see FIGS. 10A and 10B. Continued application of the force may be used to access the first configuration. Rotation may be resisted by locking detents to keep the assembly 75 in the desired configuration until a force sufficient to overcome the detent is applied in the manner addressed above.

Figure 11A:
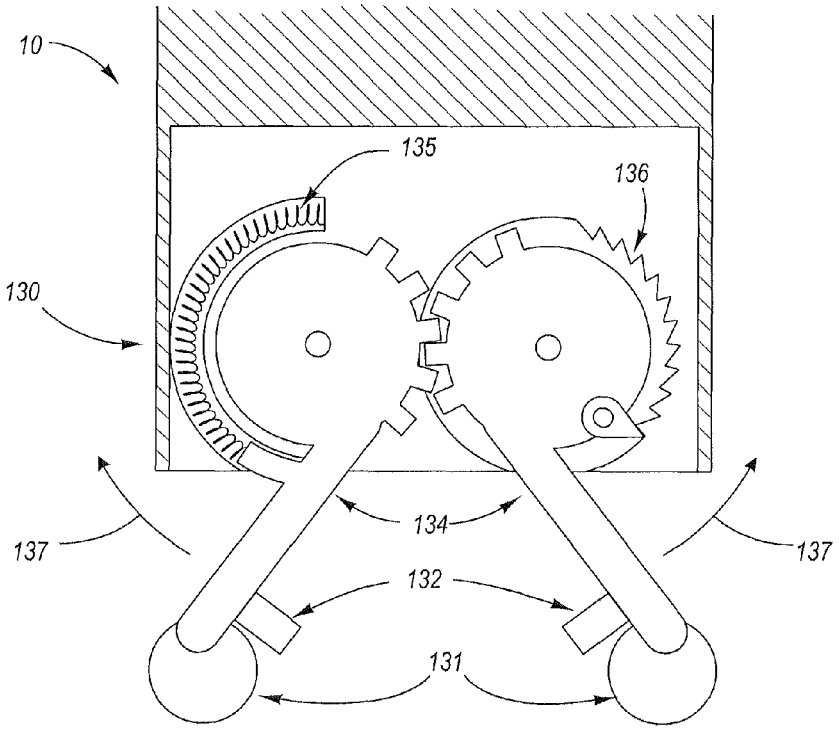
FIG. 11A depicts a cut away end view of a fifth embodiment of the motility assembly of the device in a mobile configuration, in accordance with the present invention.
Figure 11B:
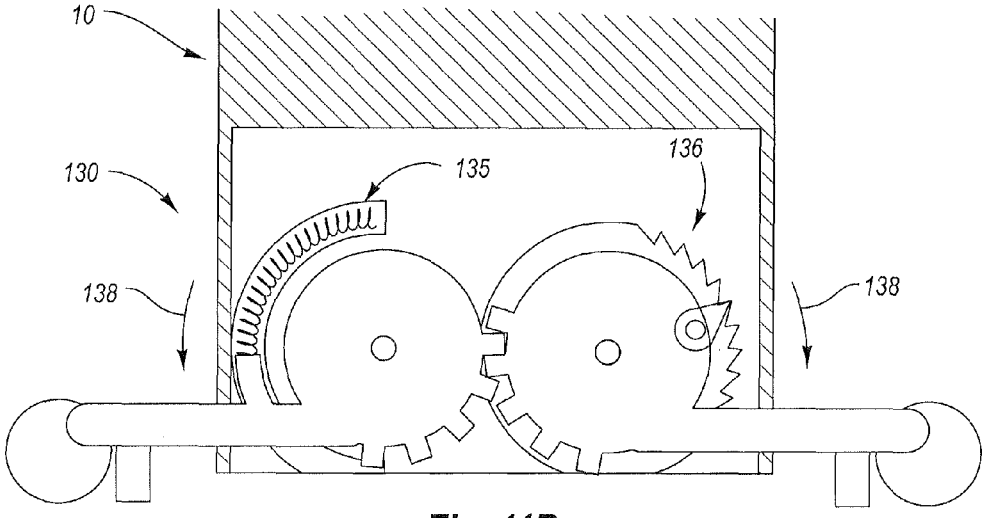
FIG. 11B depicts a cut away side view of a fifth embodiment of the motility assembly of the device in a stationary configuration, in accordance with the present invention.

Referring to FIGS. 11A and 11B, one embodiment of the present invention focuses on a motility assembly 130 operably integrated with a partition body 10. The assembly 130 may comprise two support arms 134 coupled for simultaneous movement. The support arms 134 may have wheels 131 to provide mobility of a partition device. The support arms 134 may have feet 132 to provide stability when a partition device is statically positioned. As represented in FIGS. 11A and 11B, a coupling of two support arms may be a gear-type interface. The support arms 134 may be attached to the partition body 10 such that the axes of rotation for the support arms are fixed relative to the partition body 10. Rotation of either support arm 134 may cause a corresponding rotation in the other, causing the two support arms to move in-and-out in a scissor-like motion as illustrated by directional arrows 137 and 138. Swivel wheels 131 and feet 132 may be attached at the opposite ends of the support arms 134 from the gear-type interface. The swivel wheels 131 and feet 132 may be configured to contact a support surface, but not at the same time. For example, the swivel wheels 131 and feet 132 may be configured such that when the support arms 134 are in a "V" shape, the swivel wheels 131 will be in contact with a support surface but the feet 132 will not. This provides for mobility of a partitioning device. On the other hand, the swivel wheels 131 and feet 132 may be configured such that when the support arms 134 are substantially collinear or in a flattened "V" shape, the feet 132 will be in contact with a support surface but the swivel wheels 131 will not. This provides for a partitioning device to be stably supported while statically positioned. A spring 135 may be incorporated to provide force for support arm 134 movement. Alternatively, in place of a spring, a lever accessible outside a partition body 10 may be used to apply a force for support arm movement. Additionally, a locking mechanism 136 may be incorporated to prevent unintentional movement of the support arms. The locking mechanism 136 may be released via a lever accessible outside of the partition body 10.

Referring to FIGS. 12A-12D, an interconnect may be configured for removably attaching a plurality of partitioning devices together. An interconnect may be attached to any side or face of a partition body. An interconnect may attach to a side or face by sliding a T-bar 125 into an interlocking groove such as a T-slot, or fastening by screws, bolts, clamps, etc. A T-bar may be a part of an interconnect or a partition body. Similarly, an interlocking groove such as a T-slot may be part of an interconnect or a partition body. An interconnect may take on a variety of forms as represented by several embodiments in FIGS. 12A-12D. For example, referring to FIG. 12A, an interconnect 90 may comprise: an interconnect plate 91, an interconnect arm 92, and an interconnect head 93. The plate 91 has height and width dimensions in a range from about 2 inches to about 7 inches by 1 inch to about 6 inches respectively. The plate 91 further has a depth dimension in a range from about 0.5 inch to about 1 inch.

The interconnect plate 91 is attached to the interconnect head 93 via the interconnect arm 92. The arm 92 extends out and downward such that the head 93 or a portion of the head 93 is below a plate bottom 94. The arm 92 is typically integrated with the plate 91 and the head 93. Alternatively though, it can be envisioned that the arm 92 may be removably attachable to the plate 91, the head 93, and/or both. An interconnect may be composed of materials that allow the interconnect to function with the partition body 10. Examples of materials include but are not limited to metals, metal blends or composites, ceramics or ceramic composites, natural materials such as wood, and the like.

Figure 12A:
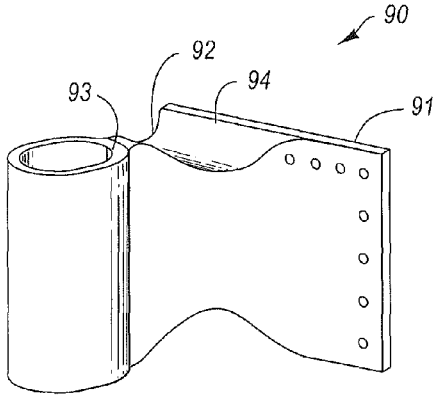
FIG. 12A depicts a first embodiment of an interconnect of the device, in accordance with the present invention.
Figure 12B:
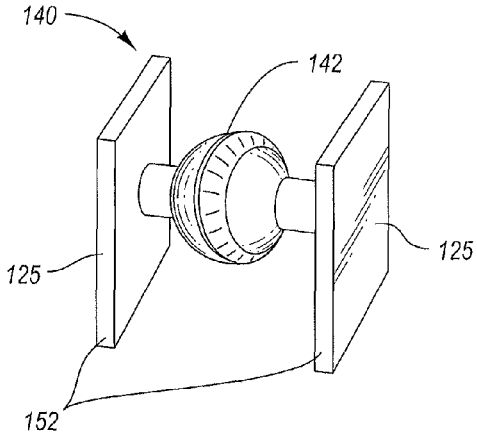
FIG. 12B depicts a second embodiment of an interconnect of the device, in accordance with the present invention.

Referring to FIG. 12B, one embodiment of an interconnect may comprise a ball and socket joint 140. The ball and socket components may be removably connectable, such as by snapping together. A ball component 141 may be located on a partition device such that it may engage a socket 142 component located on another partition device. On the other hand, the ball and socket components may be permanently connected to each other and attached to partition devices once the devices are in close proximity. The ball and socket embodiment may allow an interconnect to provide 360° angle rotation of a partition device. For example, a partition device may have two ball and socket type interconnects located on opposite ends of the device at the same vertical height. Assuming no other attachment points, the partition device may be rotated about the horizontal axis created by the two interconnects. This type of interconnect may allow a broad range of motion.

Figure 12C:
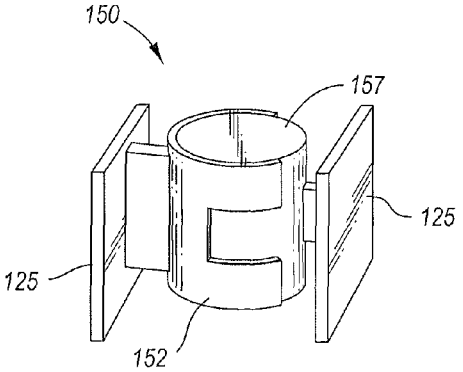
FIG. 12C depicts a third embodiment of an interconnect of the device, in accordance with the present invention.

Referring to FIG. 12C, another embodiment may be a cylindrical interconnect 150. A cylindrical interconnect 150 may comprise a cylinder 151 within a cylindrical shell 152. One type of cylindrical interconnect may resemble a door hinge. The cylindrical interconnect components may be removably connectable, such as by snapping or sliding together. A cylindrical component 151 may be located on a partition device such that it may engage a cylindrical shell component 152 located on another partition device. On the other hand, the cylindrical interconnect components may be permanently connected to each other and attached to partition devices once the devices are in close proximity. The cylindrical interconnect embodiment may allow a broad range of rotation for a partition device.

Figure 12D:
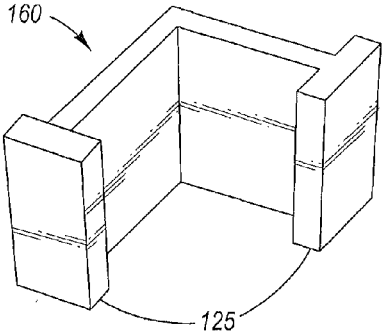
FIG. 12D depicts a fourth embodiment of an interconnect of the device, in accordance with the present invention.
Figure 13A:
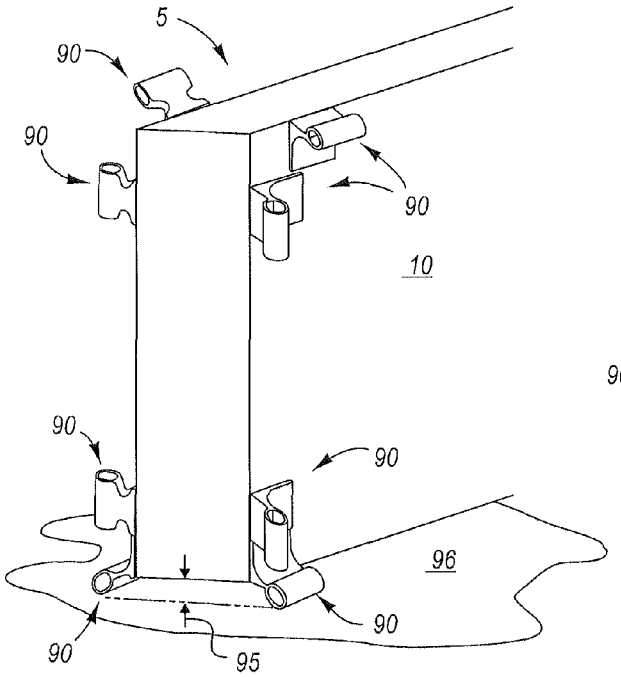
FIG. 13A depicts a perspective view of an embodiment of the device including interconnects, in accordance with the present invention.
Figure 13B:
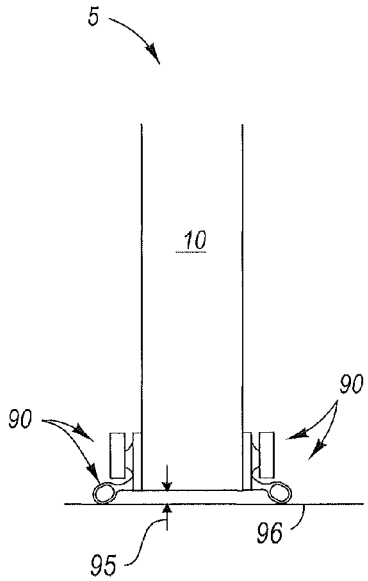
FIG. 13B depicts an end view of an embodiment of the device including interconnects, in accordance with the present invention.
Figure 13C:
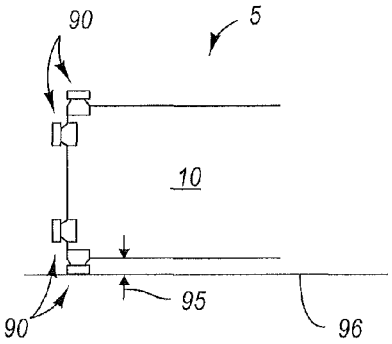
FIG. 13C depicts a side view of an embodiment of the device including interconnects, in accordance with the present invention.
Figure 13D:
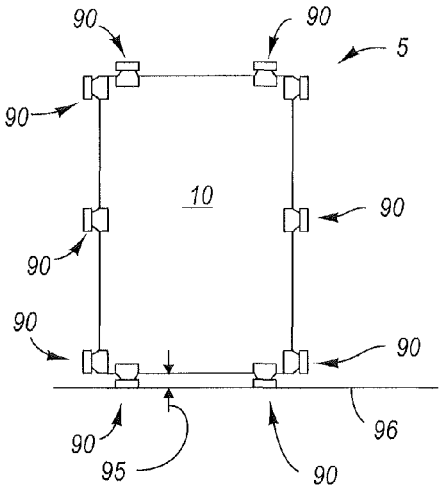
FIG. 13D depicts another side view of an embodiment of the device including interconnects, in accordance with the present invention.

Referring to FIG. 12D, another embodiment may be a fixed angle interconnect 160. A fixed angle interconnect may connect a plurality of partition devices without allowing a variation of the relative angle between them. Fixed angle interconnects 160 may be provided in a variety of angles. A fixed angle interconnect may resemble a "L" bracket for connecting two partition devices, a "Y" bracket for connecting three partition devices, or a "+" bracket for connecting four partition devices, etc.

Referring to FIGS. 13A-13D, the interconnects 90 are attached to the partition body 10 at multiple places. Interconnects may be attached to any face or side of the body 10. In the case of a cuboid body 10 as represented in FIGS. 13A-13D, ten interconnects may be attached in the periphery of each rectangular face: eight in the corner regions and one on each long side. The interconnects 90 are extended a distance 95 below the bottom of the partition body 10 in a range from about 0.5 inch to about 1.5 inches. In this configuration, the body 10 is supported and stabilized in a position normal to a surface 96 that the interconnects 90 rest on.

Figure 14:
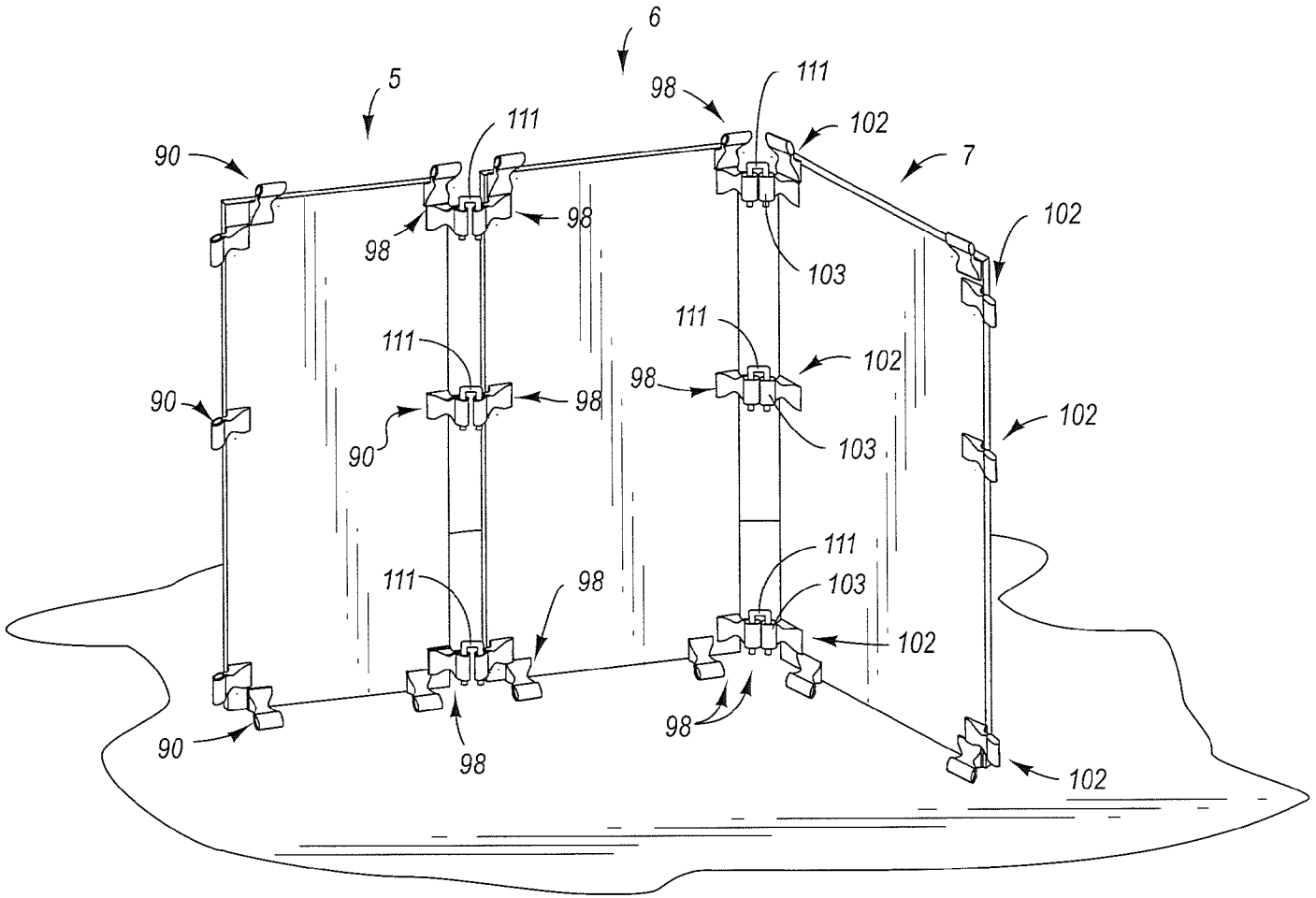
FIG. 14 depicts a perspective view of a first embodiment of partitioning devices in use, in accordance with the present invention.
Figure 15:
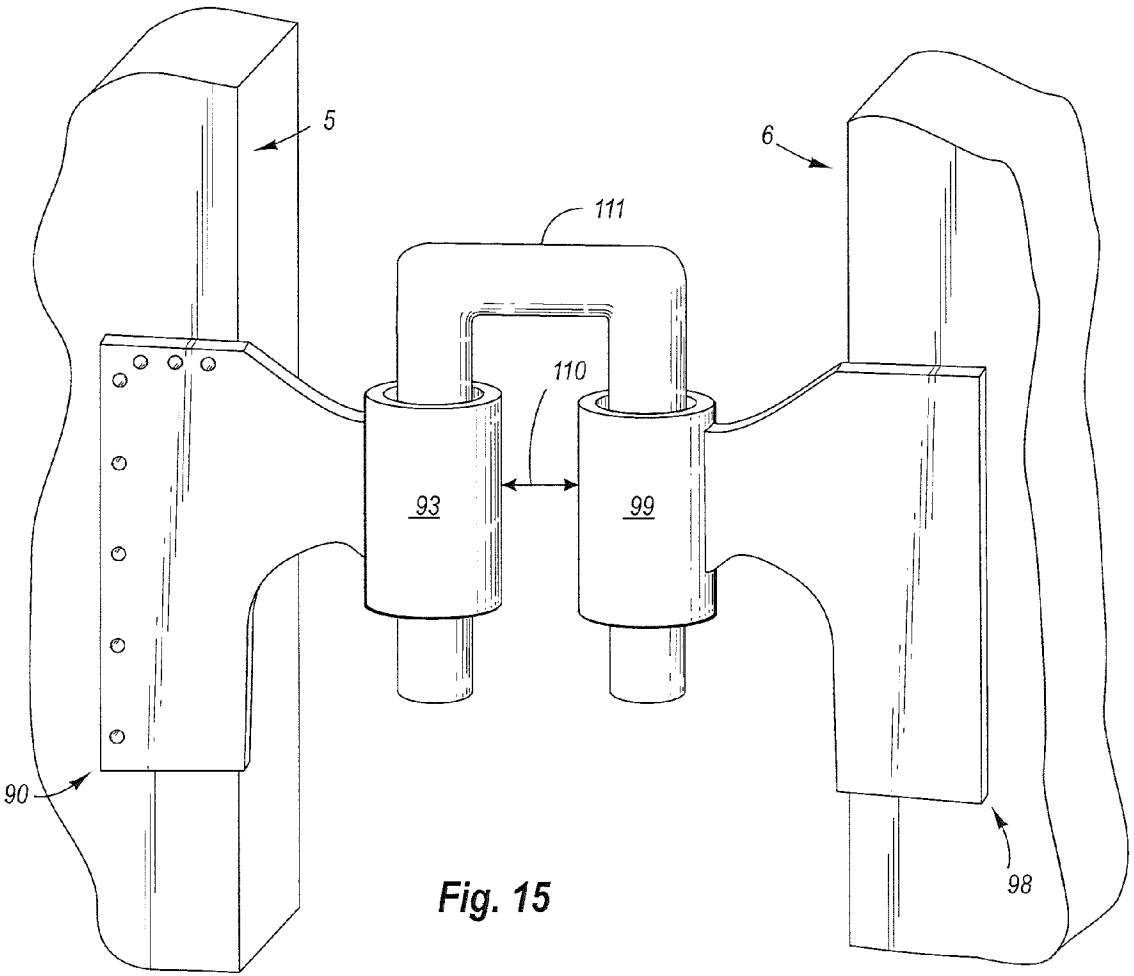
FIG. 15 depicts a close up view of an embodiment of interconnects of the partitioning device in use, in accordance with present invention.

Referring to FIGS. 14 and 15 in use of the partitioning devices, three rectangular shaped partitioning devices 5, 6, and 7 are provided. Each device 5, 6, and 7 is placed on the surface 96 with the long sides vertical. The interconnects 90, 98, and 102 are used to support each device 5, 6, and 7, respectively, a distance 95 above the surface 96.

Devices 5 and 6 further are placed in line with each other such that three of the interconnects 90 and three of the interconnects 98 of each device 5 and 6 are in a general vicinity of one another. The interconnects 90 and 98 may be placed a distance 110 from another. The distance 110 maybe in a range from about 0.5 inch to about 2 inches. The devices 5 and 6 may be secured to each other via a U-bolt 111. Although a U-bolt 111 and interconnects may be described and claimed throughout the application, it should be understood that in place of U-bolt 111 and respective interconnects, many various types of connecting members may be used to join one partitioning device to another. That is, those types disclosed in FIGS. 12A, 12B, 12C, and 12D are inherently included herein. Additionally included herein are those equivalents to the interconnects disclosed herein which may be known and understood by persons having skill in the art. The bolt 111 may be inserted into each interconnect head 93 and 99 so as to prevent the heads 93 and 99, and by extension the devices 5 and 6 from separating or disengaging.

Device 7 may then be connected to the device 6 forming a generally 90° angle. Similar to the description above, device 6 and 7 may be placed near each other such that three of the interconnects 98 and three of the interconnects 102 of each device 6 and 7 are in a general vicinity of one another. The interconnects 98 and 102 may be placed a distance 110 from another. The devices 6 and 7 may be secured to each other via a U-bolt 111. The bolt 111 may be inserted into each interconnect head 99 and 103 so as to prevent the heads 99 and 103, and by extension the devices 6 and 7 from separating or disengaging.

The above example describes connecting the device 5 with device 6 in a generally straight line and connecting the device 6 with device 7 at a generally 90° angle via the interconnects 98, 99, and 102 respectively. The description is not meant to limit the scope of the configuration of the devices 5, 6, and 7 in use in an embodiment of the present invention. The partitioning devices 5, 6, and 7 as well as any other partitioning devices maybe configured in any shape allowed via the interconnects of the aforementioned devices, in accordance with the present invention.

For example, the partitioning devices may be configured in shapes such as an "L", a "T", a "V", a wall, a divider, a cube, a rectangle, a triangle, and the like. The partitioning devices may also be configured so as to provide private rooms and cubicle like structures.

Figure 16:
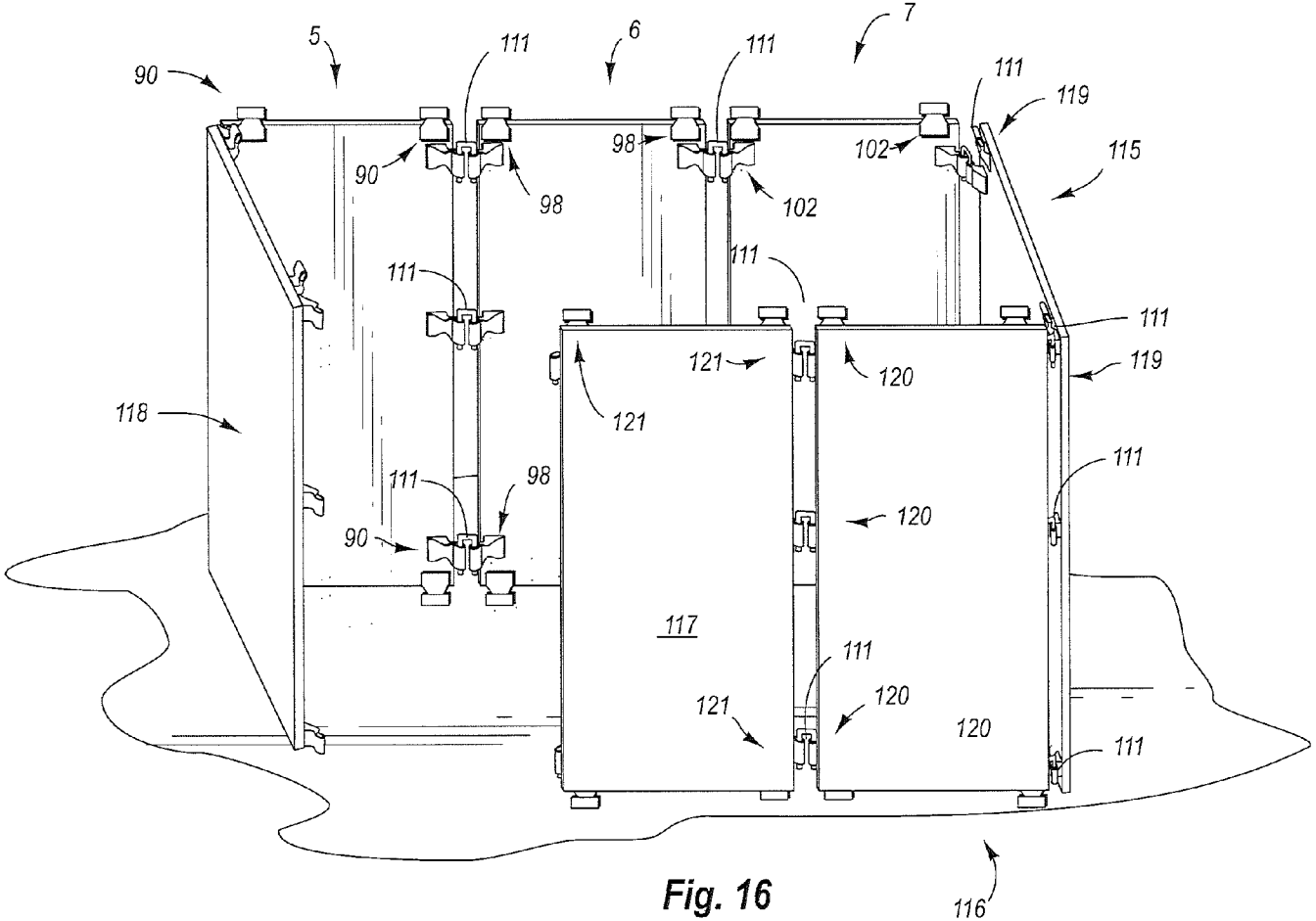
FIG. 16 depicts a perspective view of a second embodiment of partitioning devices in use, in accordance with the present invention.

Referring to FIG. 16, in use of the partitioning devices, seven rectangular shaped partitioning devices 5, 6, 7, 115, 116, 117, and 118 are provided to form a private room or cubicle like structure. Each device 5, 6, 7, 115, 116, 117, and 118 is placed on the surface 96 with the long sides vertical. The devices respective interconnects 90, 98, 102, 119, 120, 121, and 122 are used to support each partitioning device a distance 95 above the surface 96.

The devices 5, 6, 7, 115, 116, 117, and 118 are placed and configured to allow formation of a cubicle like structure. The devices 5, 6, 7, 115, 116, 117, and 118 are placed near each other such that the interconnects 90, 98, 102, 119, 120, 121, and 122 respectively of the aforementioned devices are able to be locked and secured in place relative to each other. This may be accomplished via a U-bolt 111. The bolt 111 may be inserted into the interconnects 90, 98, 102, 119, 120, 121, and 122 so as to prevent the interconnects, and by extension the devices 5, 6, 7, 115, 116, 117, and 118 from separating or disengaging. As such, two of the devices may be attachable such that a first face of a first device extends in a plane that is different from a plane that a second face of a second device extends when the first device is connected to the second device.

The above example portrays connecting rectangular shaped partitioning devices in a configuration wherein the devices are positioned with the long sides vertical. The vertical configuration is not meant to limit the scope of the configuration of the devices in use in an embodiment of the present invention. The partitioning devices may also be configured wherein the devices are positioned with the long sides horizontal, or a combination of the two configurations in accordance with the present invention.

Figure 17:
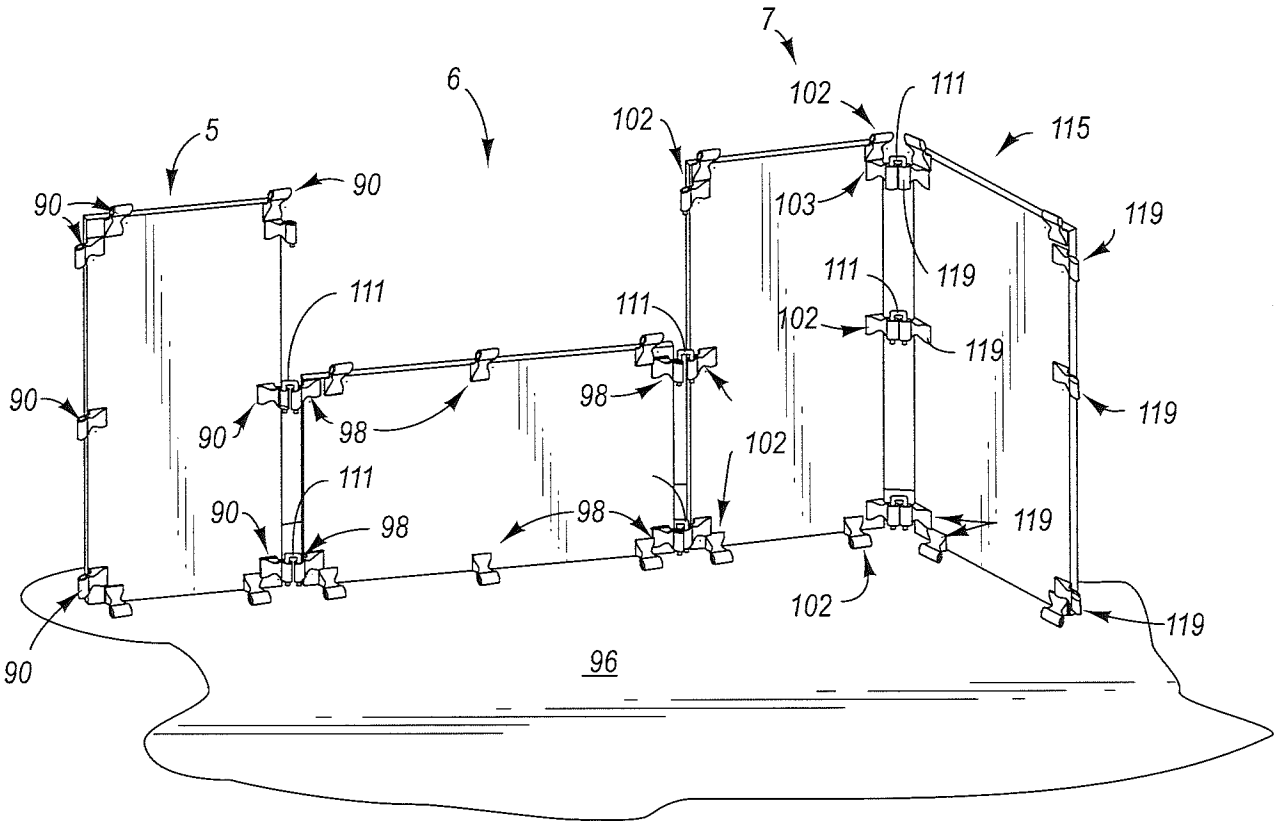
FIG. 17 depicts a perspective view of a third embodiment of partitioning devices in use, in accordance with the present invention.

Referring to FIG. 17 in use of the partitioning devices, four rectangular shaped partitioning devices 5, 6, 7, and 115 are provided. Devices 5, 7, and 115 are placed on the surface 96 with the long sides vertical and device 6 is placed with the long sides horizontal. The interconnects 90, 98, 102, and 119 may be used to support each device 5, 6, 7, and 115, respectively, a distance 95 above the surface 96.

Devices 5, 6, and 7 further are placed in line with each other such that two of the interconnects 90 and two of the interconnects 98 of each device 5 and 6 are in a general vicinity of one another. The devices 5 and 6 may be secured to each other via a U-bolt 111. The bolt 111 may be inserted into each interconnect head 93 and 99 so as to prevent the heads 93 and 99, and by extension the devices 5 and 6 from separating or disengaging. The devices 6 and 7 may also be secured to each other via a U-bolt 111. The bolt 111 may be inserted into each interconnect 98 and 102 so as to prevent the interconnects 98 and 102, and by extension the devices 6 and 7 from separating or disengaging.

Device 115 may be connected to the device 7 forming a generally 90° angle. Similar to the description above, device 7 and 115 are placed near each other such that three of the interconnects 102 and three of the interconnects 119 of each device 7 and 115 are in a general vicinity of one another. The devices 7 and 115 may be secured to each other via a U-bolt 111. The bolt 111 may be inserted into each interconnect 102 and 119 so as to prevent the interconnects 102 and 119, and by extension the devices 7 and 115 from separating or disengaging.

The above example describes connecting the partitioning devices 5, 6, and 7 in a generally straight line and connecting the device 115 with device 7 at a generally 90° angle via the interconnects 98, 99, 102, 119, respectively. The description is not meant to limit the scope of the configuration of the devices 5, 6, 7, and 115 in use in an embodiment of the present invention. The partitioning devices 5, 6, 7, and 115 as well as any other partitioning devices may be configured in any shape allowed via the interconnects of the aforementioned devices, in accordance with the present invention.

For example, the partitioning devices may be configured in shapes such as an "L", a "T", a "V", a wall, a divider, a cube, a rectangle, a triangle, and the like. The partitioning devices may also be configured such that as to provide private rooms and cubicle like structures.

Figure 18:
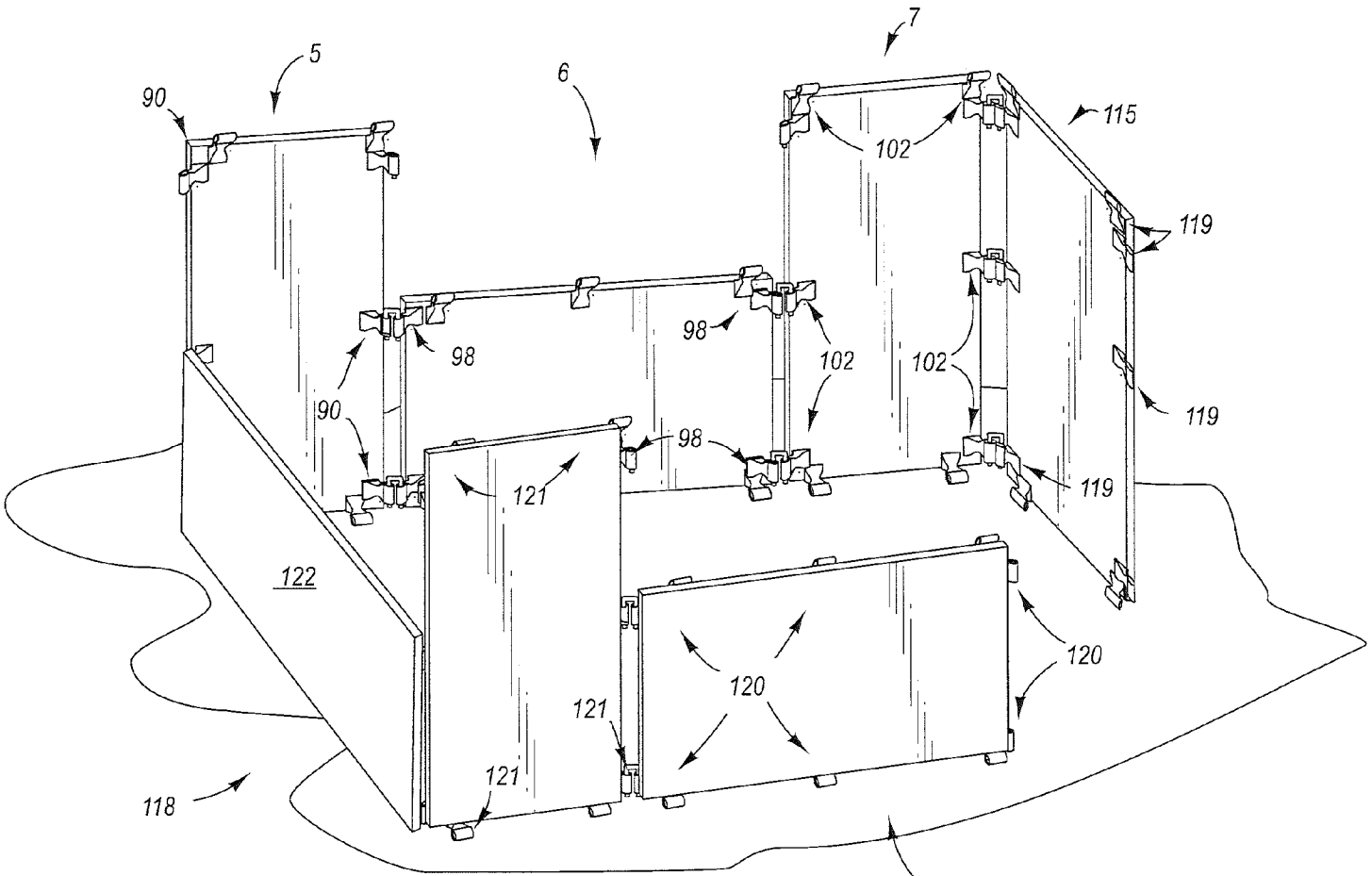
FIG. 18 depicts a perspective view of a fourth embodiment of partitioning devices in use, in accordance with the present invention.

Referring to FIG. 18 in use of the partitioning devices, seven rectangular shaped partitioning devices 5, 6, 7, 115, 116, 117, and 118 are provided to form a private room or cubicle like structure. Devices 5, 7, 115, and 117 are placed on the surface 96 with the long sides vertical while devices 6, 116, and 118 are placed on the surface 96 with the long sides horizontal. The devices' respective interconnects 90, 98, 102, 119, 120, 121, and 122 may be used to support each partitioning device a distance 95 above the surface 96.

The devices 5, 6, 7, 115, 116, 117, and 118 are placed and configured to allow formation of a cubicle like structure. The devices 5, 6, 7, 115, 116, 117, and 118 are placed near each other such that the interconnects 90, 98, 102, 119, 120, 121, and 122, respectively, of the aforementioned devices are able to be locked and secured in place relative to each other. This may be accomplished via a U-bolt 111. The bolt 111 may be inserted into the interconnects 90, 98, 102, 119, 120, 121, and 122 so as to prevent the interconnects, and by extension the devices 5, 6, 7, 115, 116, 117, and 118 from separating or disengaging.

The above examples each portray connecting rectangular shaped partitioning devices in a configuration wherein the rectangular shaped partitioning devices appear to be of roughly equal dimensions. The dimensions of each of the rectangular shaped partitioning devices portrayed respective to one another is not meant to limit the scope of the configuration of the devices in use in an embodiment of the present invention. That is, the rectangular shaped partitioning devices may be used to configure, for example, a table structure, a desk structure, a doored structure or a shelving structure. Further, the partitioning devices may also be configured wherein the devices are configured from a variety of dimensioned rectangular shaped partitioning devices. Therefore, configurations such as a table structure, a desk structure, a doored structure, or a shelving structure may be comprised of rectangular shaped partitioning devices with differing dimensions in accordance with the present invention.

Figure 19:
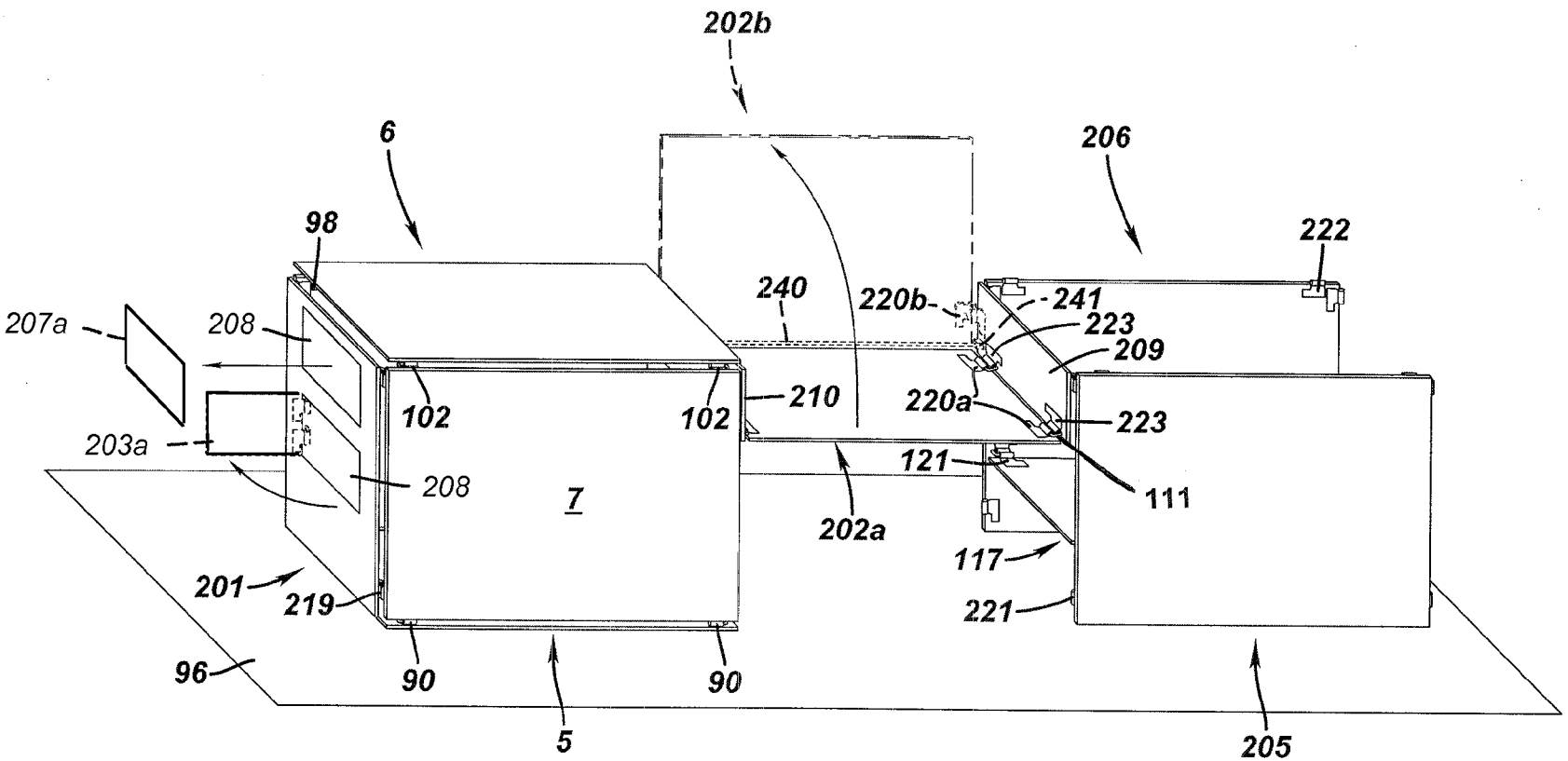
FIG. 19 depicts a perspective view of a fifth embodiment of partitioning devices in use, in accordance with the present invention.

Referring to FIG. 19 in use of the partitioning devices, eight rectangular shaped partitioning devices 5, 6, 7, 201, 202*a*, 205, 206, 209, 210 and 117 are provided to form a desk-like configuration. Each of the devices 5, 205, and 206 may be placed to contact the surface 96 such that devices 6, 7, 201, 202*a*, 209 and 117 do not come into contact with the surface 96. The devices' interconnects, 90, 98, 102, 219, 220*a*, 221, 222, 223 and 121, may be used to support each partitioning device in, for example, a desired configuration above the surface 96. That is, the devices 5, 6, 7, 201, 202*a*, 205, 206, 209, 210 and 117 are placed near each other such that the interconnects 90, 98, 102, 219, 220*a*, 221, 222, 223 and 121, respectively, of the aforementioned devices may be locked and secured in place relative to each other. This may be accomplished via a U-bolt 111. The U-bolt 111 may be inserted into interconnects 90, 98, 102, 219, 220, 221, 222, 223 and 121 so as to prevent interconnects and by extension, the devices 5, 6, 7, 201, 202*a*, 205, 206, 209 and 117, from separating or disengaging. That is, in FIG. 19, a U-bolt 111 may be placed into two interconnects (for example, 220*a* and 223) of two different rectangular-shaped partitioning devices (202*a* and 209, respectively) so as to hold the two rectangular shaped partitioning devices together. This may be repeated for each side of a rectangular-shaped partitioning device that may, for example, be in close proximity to a side of another rectangular-shaped partitioning device so that the two may be secured together.

As shown in FIG. 19, once a desk-like structure is configured, the rectangular-shaped partitioning device 202*a* that is securedly suspended over surface 96 may be moved in such a manner so that the device may come to a rest at a point depicted by phantom rectangular-partitioning device 202*b*. Rectangular-shaped partitioning device 202*a* may be initially secured to mini-panels 209 and 210 via U-bolts 111 (or other type of interconnector, as previously discussed) connecting interconnects 220*a*, 223, and 224, of panels 202*a*, 209, and 210, respectively, to create a desk-like configuration. Thereafter, the U-bolts 111 may be removed from interconnects 220*a*, 223, and 224, and moved by various means. Further, examples that are set forth in the following paragraphs are meant to be illustrative, and non-limiting to the manner in which the panel device 202*a* may be moved into the phantom panel device 202*b* placement.

As a first example, the rectangular-shaped partitioning device 202*a* may, for example, be removably attached from either of the (now free-standing) configurations located proximal to the initial placement of rectangular-shaped partitioning panel 202*a*. The phantom rectangular-shaped partitioning panel 202*b* may then be removably reattached to the minipanels 209 and 210, but on different sides of the respective minipanels than those that were previously the sites of interconnection. U-bolts 111 may then be used to secure the interconnects 220*b* (of 202*b*) to the interconnects 223 and 224 of minipanels 209 and 210, respectively. In such a fashion, the rectangular-shaped partitioning device 202*b* (depicted as a phantom in FIG. 19) may then be substantially perpendicular to the surface 96.

As a second example, the rectangular-shaped partitioning device 202*a* may be equipped with a rotating member 240 that is removably attached to minipanels 209 and 210 respectively. The rectangular-shaped partitioning device 202*a* may either be coupled to or integral to the rotating member 240. Also, the rotation of panel 202*a* may be done in various intervals or portions. Using this manner, when the U-bolts 111 are removed from the various interconnects 220*a*, 223, and 224, the panel device 202*a* may be rotatably moved along the axis of rotating member 240 to create any degree of inclination of phantom rectangular-shaped partitioning device 202*b* from the initial state of panel device 202*a*. That is, the panel device 202*a* may be freely rotated with the rotating member 240 about an axis in a 360 degree fashion, and the phantom panel 202*b* of FIG. 19 represents but one resting place of the device after rotation may be completed. Further, the phantom panel may be secured into place with U-bolts 111 and interconnects 220*b*, 223, and 224. Alternatively, the phantom panel may be secured into place by a rotation preventing member 241 of the rotating member 240. Such a rotation preventing member may comprise any such means known and used by those skilled in the art. A rotation preventing member 241 may, for example, be either a brake member. That is, the brake member may act upon the points into which the rotating member 240 is removeably attached to the rectangular-shaped mini panels 209 and 210.

Referring again to FIG. 19, the interconnects 121 of device 117 may be secured to devices 205 and 206 at each of their respective interconnects, 221 and 222, in such a manner that device 117 may create a shelf-like structure in cooperation with devices 205 and 206. That is, the interconnects of each panel may be located in a plurality of locations such that one, two, or more shelves may be built from into configuration of the interlocking partitioning devices. Further, the shelf-like or tabletop-like configurations of panel devices 6, 202*a*, and 117 may be constructed to be load bearing for certain materials or amounts. For example, if the load were known to be great, cause an unequal weight distribution, there may be different materials used in the rectangular-shaped partitioning device that would hold all of the loaded materials on its surface area. Alternatively, if the load were known to cause an unequal weight distribution, the u-bolts may be composed of materials with a greater tensile strength, constructed with a greater diameter, or constructed with a superior weight bearing geometric shape (for example, a hexagonal configuration) than other U-bolts 111 of the configuration. Additionally, although not depicted in FIG. 19, any of the interconnect configurations known and appreciated in the art, as well as those previously illustrated, for example, in FIGS. 12A, 12B, 12C, 12D, and 15 may be used in various configurations.

The above examples each portray rectangular shaped partitioning devices in a configuration wherein the rectangular shaped partitioning devices appear without any inconsistencies in the face of the device. The homogenously appearing face of the rectangular shaped partitioning devices is not meant to limit the scope of the configuration of the devices in use in an embodiment of the present invention. That is, the rectangular shaped partitioning devices may be configured to have one or more openings in the face of the rectangular partitioning device. Also, the openings may be made of the same material as the rectangular shaped partitioning device, or it may be comprised of different materials.

Referring to the rectangular-shaped partitioning device 201 of FIG. 19, a partitioning device may be configured to have openings in its face. The openings in device 201, for example, may have removably attached covers or doors to cover the opening. As illustrated, device 201 has two openings in its face. However, a device may have no openings, one opening, or a plurality of openings in its face. Further, an opening in a partitioning device may transgress through the entirety of a face of a partitioning device. Alternatively, the opening may only go through a portion of the rectangular-shaped partitioning device. Such examples will be discussed further, infra.

As shown in FIG. 19, a removably attached door 203*a* may have interconnects 204, and may be connected to the interconnects 219 of the rectangular shaped partitioning device 201 by u-bolts 111. However, it should be noted that although interconnects shown in FIG. 15 are depicted, any of the interconnects illustrated in FIG. 12A, 12B, 12C, or 12D, or any other interconnects known and appreciated in the art may be used. As shown in FIG. 19, one side of the removably attached door 203*a* may be connected to the rectangular shaped partitioning device 201 with the interconnects. When interconnected in this fashion, the removably attached door 203*a* may be swung along the axis of movement created by the interconnects and U-bolts 111, and with such movement, the removably attached door 203*a* may be opened and closed. The closed configuration will be more thoroughly discussed below.

For example, the removably attached door 203*a* may fit into the opening of rectangular partitioning device 201 so as to create a consistent surface area. Alternatively, the door removably attached 203*a* may fit onto or over the opening in rectangular shaped partitioning device 201 such that at least a portion of the removably attached door 203*a* may create an inconsistency in the surface of the rectangular shaped partitioning device 201 that may be readily visible by an observer. Also, if the door is in either configuration, the removably attached door 203*a* may be secured in a closed position so that it may not freely open. For example, an additional interconnect may be present on the removably attached door 203*a* and the rectangular shaped partitioning device 201 such that at least one additional side of the removably attached door 203*a* may be interconnected to the device 201 with interconnects 204. Alternatively, there are many attaching means available in the art to secure the removably attached door 203*a* to the rectangular shaped partitioning device 201. For example, the door 203*a* may be removably secured to the rectangular shaped partitioning device 201 with a hook and loop, button and hole, zipper, Velcro® hook and eye, button and snap, a door knob and accompanying bar, et cetera. Alternatively, the removably attached door 203*a* may not be connected with interconnects; rather, the removably attached door may be configured to fit inside of the rectangular shaped partitioning device 201 and translationally slide open to reveal the opening or slide closed to close the opening.

Although FIG. 19 shows that removably attached door 203*a* may be removably attached to the rectangular partitioning device, the removable cover 207*a* may be completely removed from the rectangular shaped partitioning device 201 to yield an opening. This completely removed position of the removable cover 207*a* is depicted in FIG. 19. Similar to door 203*a*, the removable cover 207*a* may be either (a) fitted into the opening of device 201 so that there are no visual surface irregularities in the face of device 201 or (b) fitted over or onto the rectangular shaped partitioning device 201 so that at least a portion of the removable cover 207*a* is readily visible to an observer. Similarly, the removable cover 207*a*, while in a closed position, may be secured as previously discussed with respect to removably attached door 203*a*. Also, the removable cover 207*a* may be, for example, a portion of the rectangular shaped partitioning device. For example, as depicted in FIG. 19, the device 201 may have had a preexisting substantial perforation along a predetermined perimeter. At the user's option, then, the perforation into the rectangular shaped partitioning device may be completed, and the removable cover 207*a* may be removed. Alternatively, the removable cover 207*a* may have been placed either on or in the rectangular shaped partitioning device 201 in such a manner that it was already completed detached from the device 201 and ready to be removed from the apparatus by a user.

With respect to any doors or covers associated with covering an opening in a rectangular shaped partitioning device, the doors or covers may be labeled or otherwise denoted (e.g. different colored or patterned material from the remainder of the partitioning device) so that they may indicate to a user that a door or cover exists in the partitioning device that may be removably attached or completely removed therefrom. Specifically referring to FIG. 19, upon removal of either the removably attached door 203*a* or the completely removable cover 207*a*, the opening in the partitioning device 201 may be either a complete via from one side of the rectangular shaped partitioning device to the other, or an inner pane 208.

The inner pane 208 may be designed to facilitate the transfer of either light or sound, or a combination thereof. That is, inner pane 208 may, for example, be composed of a transparent or translucent material that would allow light to propagate from one side of device 201 through inner pane 208 to the other side of device 201. [It should be mentioned that there are also some opaque materials that may still transfer light therethrough, given an appropriate thickness or density of the opaque material. Such materials, given the properties aforementioned, are also inherently included in the current discussion.] For example, the inner pane 208 may be completely transparent to facilitate an observer's or user's vision through device 201, in effect creating a window in the rectangular partitioning device 201 with either a cover 207*a* or a removably attached door 203*a*. As another example, the inner pane 208 may be translucent to facilitate the filtration of light from one side of the device 201 to the other side of device 201, while fostering privacy of the environment of one side of the device 201 from the other side of the device 201 by maintaining a limited visibility through the pane 208. Additionally, as previously stated, the device 201 may comprise an inner pane 208 that facilitates the propagation of sound from one side of the device 201 to the other side of device 201. That is, the inner pane 208 may be comprised of a material less dense than the device 201, a material with a small thickness, or of a material with a plurality of vias or perforations therethrough, such that sounds may easily transfer from one side of the device 201 to the other side of device 201. An inner pane 208 for light or sound propagation may be useful in cases where a configuration of rectangular shaped partitioning devices comprises several devices which are of a substantial surface area, or where a configuration comprises many individual devices. In such exemplary cases, it would benefit a user to be able to listen, see or otherwise communicate through an inner pane 208. Finally, the pane may comprise a combination of both sound and light propagating materials. Such an arrangement may allow a user to see, listen, communicate, and observe an environment from one side of the device 201 to the other side of device 201. Additionally, the environment on one side of the device 201 may benefit from the filtration of light from one side of the device 201 to the other side of device 201.

In addition to light and sound propagation, the inner pane 208 may also be composed of a material that is either heat conductive or heat resistant. With such a material comprising the inner pane 208, temperature regulation or fluctuation may be facilitated and more easily and efficiently accomplished. This may be beneficial, for example, when regulating an ambient temperature of one or more configurations that do not individually have access to one or more temperature regulating means.

Modifications and variations of the described apparatus and methods of the invention will be apparent to those skilled in the art without departing from the scope and spirit of the invention. Although the invention has been described in connection with specific embodiments, outlined above, it should be understood that the invention should not be unduly limited to such specific embodiments. Various changes may be made without departing from the spirit and scope of the invention as defined in the following claims.

What is claimed is:

1. A system for partitioning space comprising:

a first partitioning device comprising four edges;

a second partitioning device comprising four edges, wherein said first partitioning device includes a first interconnect, wherein said second partitioning device includes a second interconnect, wherein said first and second interconnects are used to interchangeably link said first partitioning device with a second partitioning device, wherein the first and second interconnects comprise a ball and socket joint and wherein:

in a first connected configuration, the first partition body is in a first orientation with respect to the second partition body;

in a second connected configuration, each of the edges the first partition body are rotated with respect to the second partition body compared with the first orientation of the first connected configuration such that the side edges in the first orientation become top and bottom edges in the second orientation; and in a third connected configuration, the first partitioning body is perpendicular to the second partitioning body; and wherein the first partition body is configured to rotate with respect to the second partition body when linked in each of the first connected configuration, the second connected configuration and the third connected configuration;

at least a first removably attachable portion on said first partitioning device; and a second removably attachable portion attachable to the first partitioning device in the same location as the first removably attachable portion is attachable, wherein said second removably attachable portion is different than said first removably attachable portion;

a transparent pane located in the first partitioning device where both the first and second removably attachable portions are attachable such that the transparent pane is substantially hidden when at least one of the first and second removably attachable portions are attached and the transparent pane is exposed when at least one of the first and second removably attachable portions are removed.

2. The system of claim 1, wherein said first and second interconnects provide support to said first partitioning device and said second partitioning device.

3. The system of claim 1, wherein said first partitioning device and second partitioning device further comprises a structure that encourages ease of movement, said structure that encourages ease of movement operably attached to said partitioning devices.

4. A device comprising:

a first partition body having four edges and a first face;

at least one structure that encourages ease of movement operably adapted to said first partition body;

a first interconnect positioned along an edge of the first face for supporting the first partition body on a surface, and a second interconnect, wherein the second interconnect is used to interchangeably link said first partition body with a second partition body, having a second face, in a plurality of connected configurations, wherein the first and second interconnects comprise a structure of a ball and socket that operates as a universal joint, said structure of a ball and socket that operates as a universal joint configured to link said first partition body with said second partition body; and wherein in a first connected configuration, the first partition body is in a first orientation with respect to the second partition body;

in a second connected configuration, each of the edges the first partition body are rotated ninety degrees with respect to the second partition body compared with the first orientation of the first connected configuration such that the side edges in the first orientation become top and bottom edges in the second orientation; and wherein the face of the first partition body extends in a different plane than the face of the second partition body when the first partition body is connected to the second partition body in at least one of the first connected configuration and the second connected configuration.

5. The device of claim 4, wherein said partition body comprises at least one face having a length in a range from about 5 feet to about 6.5 feet and a width in a range from about 2 feet to about 3.5 feet.

6. The device of claim 5, wherein said at least one face composition may include materials selected from a group consisting of polyester, rayon, nylon, sateen, spandex, plastic, cotton, satin, silk, steel, aluminum, sheet rock, wood, plexiglass, fiber glass, nanocomposites, and combinations thereof.

* * * * *

UNITED STATES PATENT AND TRADEMARK OFFICE

CERTIFICATE OF CORRECTION

PATENT NO. : 8,857,496 B2
APPLICATION NO. : 11/868995
DATED : October 14, 2014
INVENTOR(S) : Keith A. Raniere It is certified that error appears in the above-identified patent and that said Letters Patent is hereby corrected as shown below:

In the Claims

In Claim 1, Column 18 Line 8-9, insert the word --of-- after the word "edges."

In Claim 4, Column 18 Lines 64-65, insert the word --of-- after the word "edges."

Signed and Sealed this
Thirtieth Day of June, 2015

Michelle K. Lee

Michelle K. Lee
*Director of the United States Patent and Trademark Office*